US010596410B1

(12) United States Patent
Greene

(10) Patent No.: US 10,596,410 B1
(45) **Date of Patent: *Mar. 24, 2020**

(54) MULTI-FUNCTION EXERCISE BENCH WITH SWIVELABLE SEATBACK AND AT LEAST THREE PAIRS OF SYMMETRICALLY POSITIONED HANDLES

(76) Inventor: Donald D. Greene, Cleveland, OH (US)

( * ) Notice: Subject to any disclaimer, the term of this patent is extended or adjusted under 35 U.S.C. 154(b) by 1395 days.

This patent is subject to a terminal disclaimer.

(21) Appl. No.: 13/462,763

(22) Filed: May 2, 2012

Related U.S. Application Data

(62) Division of application No. 11/508,424, filed on Aug. 22, 2006, now Pat. No. 8,206,272.

(51) Int. Cl.
*A63B 22/06* (2006.01)
*A63B 21/00* (2006.01)

(52) U.S. Cl.
CPC ..... *A63B 22/0605* (2013.01); *A63B 21/4034* (2015.10); *A63B 21/4045* (2015.10); *A63B 2022/0652* (2013.01)

(58) Field of Classification Search
CPC ..... A63B 21/4031; A63B 21/4033; A63B 21/4034; A63B 21/4035
USPC ..... 11/508, 424; 482/57, 58, 59, 62, 140, 482/142, 148; 297/61, 92, 101, 215.12, 297/215.13; 446/465
See application file for complete search history.

(56) References Cited

U.S. PATENT DOCUMENTS 226,578 A * 4/1880 Whitmore ..... 280/256
356,388 A * 1/1887 Whitmore ..... B62B 5/0083 280/62
3,712,613 A * 1/1973 Feather et al. ..... 482/138
4,140,312 A * 2/1979 Buchmann ..... A63B 22/0605 482/62
4,456,277 A * 6/1984 Carpenter ..... 280/282
4,566,691 A 1/1986 Mahnke
4,705,269 A * 11/1987 DeBoer ..... A63B 22/001 280/232
4,798,379 A * 1/1989 Jenkins ..... A63B 21/154 482/115
5,039,092 A 8/1991 Olschansky et al.
5,215,511 A 6/1993 Cheng
(Continued)

OTHER PUBLICATIONS

"Easy Cycle Mini Exercise & Rehabilitation Cycle", Model EZC-5, net3fitness.com, Mar. 27, 2007 pp. 1 and 2.
(Continued)

*Primary Examiner* — Jennifer Robertson
(74) *Attorney, Agent, or Firm* — Ronald J. Meetin

(57) ABSTRACT

An exercise bench contains a frame (100), an overlying seat (102), a seatback (104) having a longitudinal centerline (124), a connection mechanism (106) for flexibly and/or adjustably connecting the seatback to the frame or/and the seat so that the seatback is at an adjustable angle (α) to the seat, and at least three pairs of symmetrically positioned handles (108L and 108R, 110L and 110R, 240L and 240R, 242L and 242R, and 250L and 250R) connected to the frame, the seat, the seatback, or/and the connection mechanism. The connection mechanism has a swivel axis (122) which extends generally parallel to the seatback's centerline and about which the connection mechanism is turnable to enable the seatback to swivel.

8 Claims, 23 Drawing Sheets

(56) References Cited

U.S. PATENT DOCUMENTS

| | | | | |
|---|---|---|---|---|
| 5,354,251 | A * | 10/1994 | Sleamaker | A63B 21/156 482/142 |
| 5,385,388 | A | 1/1995 | Faiks et al. | |
| 5,514,053 | A * | 5/1996 | Hawkins et al. | 482/63 |
| 5,549,535 | A | 8/1996 | Wang et al. | |
| 5,611,758 | A * | 3/1997 | Rodgers, Jr. | 482/57 |
| 5,649,886 | A | 7/1997 | Danylieko | |
| 5,759,137 | A | 6/1998 | Huang | |
| 5,833,582 | A | 11/1998 | Chen | |
| 5,967,610 | A * | 10/1999 | Lin | A47C 3/18 297/183.9 |
| 6,001,046 | A * | 12/1999 | Chang | 482/57 |
| 6,001,071 | A * | 12/1999 | Butler | 601/36 |
| 6,270,446 | B1 | 8/2001 | Abelbeck et al. | |
| 6,500,099 | B1 * | 12/2002 | Eschenbach | 482/57 |
| 6,793,608 | B2 * | 9/2004 | Goldberg | A63B 22/0605 482/57 |
| 6,805,409 | B2 | 10/2004 | Parker | |
| 6,902,515 | B2 | 6/2005 | Howell et al. | |
| 6,966,872 | B2 | 11/2005 | Eschenbach | |
| 7,128,702 | B2 | 10/2006 | Boland et al. | |
| 7,329,213 | B1 | 2/2008 | Farley | |
| 7,901,335 | B2 * | 3/2011 | Webber et al. | 482/72 |
| 8,118,715 | B2 * | 2/2012 | Greene et al. | 482/57 |
| 8,206,272 | B2 * | 6/2012 | Greene | 482/57 |
| 2002/0061804 | A1 | 5/2002 | Hasegawa | |
| 2002/0169057 | A1 | 11/2002 | Forcillo | |
| 2004/0142797 | A1 | 7/2004 | Andre | |
| 2005/0101463 | A1 | 5/2005 | Chen | |
| 2005/0202937 | A1 | 9/2005 | Cheng | |
| 2007/0129225 | A1 | 6/2007 | Hammer | |
| 2007/0149373 | A1 | 6/2007 | Dalebout et al. | |
| 2008/0081745 | A1 * | 4/2008 | Sargen et al. | 482/98 |
| 2008/0139366 | A1 * | 6/2008 | Born et al. | 482/52 |

OTHER PUBLICATIONS

"Love Handler", Product SI224SIL, sharperimage.com, Dec. 1, 2006, pp. 1 and 2.

"Pro Form GT 95 X Recumbent Bike—Converts to a workout Bench!", Dick's Sporting Goods, dickssportinggoods.com, Jul. 15, 2008, 2 pp.

"Stamina 4755 Magnetic Recumbent Bike with Heart Rate Monitor", walmart.com, Mar. 27, 2007, pp. 1-3 and one p. with enlarged image.

"ST 2-in-1 combo rowing machine & recumbent bike Recumbent Bike", fitnessblowout.com, Mar. 27, 2007, pp. 1-5.

"What Your Body Needs", Panasonic Core Trainer, *SkyMall*, 2006, p. 9.

* cited by examiner

MULTI-FUNCTION EXERCISE BENCH WITH SWIVELABLE SEATBACK AND AT LEAST THREE PAIRS OF SYMMETRICALLY POSITIONED HANDLES

CROSS-REFERENCE TO RELATED APPLICATION

This is a division of U.S. patent application Ser. No. 11/508,424, filed 22 Aug. 2006, now U.S. Pat. No. 8,118,715 B2.

FIELD OF USE

This invention relates to exercise equipment for strengthening muscles of the human body.

BACKGROUND ART

Physical exercise is important to the human body. In addition to increasing strength and stamina, physical exercise can increase longevity. Physical exercise commonly makes humans feel good physically and mentally.

Exercise machines have been developed to enable physical exercising to be done in a time-efficient manner. Some exercise machines target largely only a single feature of the human anatomy such as the legs.

Other exercise machines are designed to enable multiple features of the human anatomy, e.g., the legs and arms/shoulders, to be exercised. FIG. 1 illustrates such a multi-function exercise machine as disclosed in U.S. Pat. No. 6,902,515 B2. The prior art exercise machine of FIG. 1 consists of base assembly 20, pedal-revolving pedaling mechanism 22, seat 24, seatback 26, upper-body assembly 28, and rotational arm-shoulder device 30. Pedaling mechanism 22 includes a pair of pedals 32. When actuated by the feet of a person, pedals 32 revolve about an axis to exercise the person's legs. Arm-shoulder device 30 includes a pair of off-center handles 34 which can similarly be revolved about an axis by the person's hands to exercise the person's arms and shoulders.

FIGS. 2*a* and 2*b* illustrate two way in which upper-body assembly 28 can be connected to the back of seatback 26 (not shown in FIG. 2*a* or 2*b*) to enable portion 36 of assembly 28 to be moved in various ways while a person is exercising with the machine of FIG. 1. In the embodiment of FIG. 2*a*, back member 38 of movable portion 36 is connected by pin 40 to seatback 26 for enabling portion 36 to pivot from side to side about axis 42 that extends generally parallel to the length of base assembly 20. A pair of springs 44 connected between back member 38 and fixed base member 46 of upper-body assembly 28 provide resistance for the side-to-side movement.

In the embodiment of FIG. 2*b*, back member 38 is connected by bearing mechanism 48 to fixed base member 50 of upper-body assembly 28 for enabling movable portion 36 to pivot in various manners about bearing mechanism 48 in order to exercise the arms and shoulders. For example, movable portion 36 can pivot from front to back and vice versa about axis 52 that extends generally perpendicular to the length and height of the exercise machine. Movable portion 36 in FIG. 2*b* can also pivot about axis 54 that extends generally parallel to back member 38. Coil torsion spring 56 provides resistance to the movement of portion 36 in FIG. 2*b*. Although seat 24 and seatback 26 can be adjusted horizontally along the length of base assembly 20 to accommodate persons of different size, seat 24 and seatback 26 are substantially stationary during exercising usage when upper-body assembly 28 is implemented as shown in both FIG. 2*a* and FIG. 2*b*.

The abdominal muscles of the human body often need strengthening. While the multi-function exercise machine of FIG. 1 appears capable of providing the legs and arms/shoulders with good exercise, the machine of FIG. 1 is not particularly targeted toward the abdominal muscles. It would be desirable to have an exercise machine that can exercise both the legs and abdominal muscles.

GENERAL DISCLOSURE OF THE INVENTION

The present invention provides such an exercise machine. In accordance with the invention, an exercise machine capable of exercising both the legs and abdominal muscles of a human user contains a frame, a seat situated over the frame, a seatback, a connection mechanism for flexibly or/and adjustably connecting the seatback to the frame or/and the seat, and a pedaling mechanism connectable to the frame. The seat is located laterally between the pedaling and seatback-to-frame/seat connection mechanisms. The pedaling mechanism has a pair of pedals that can move in various ways. For example, the pedals can revolve generally around a pedaling axis. Alternatively, the pedals can translate (move linearly) back and forth. Actuation of the pedals by the user's feet causes the user's legs to be exercised.

The connection mechanism can normally turn about a swivel axis that extends generally parallel to the length of the torso of a typical user seated on the seat with the user's back lying generally against the seatback. This enables the seatback to swivel about the swivel axis, thereby exercising the user's abdominal muscles as the user's torso swivels about the swivel axis generally in synchronism with the swiveling of the seatback.

The connection mechanism also preferably adjustably connects the seatback to the frame or/and the seat so that the seatback is adjustably inclinable relative to the seat. Appropriately adjusting the seatback-to-seat incline assists in exercising the user's abdominal muscles. For instance, reducing the incline so that the seatback slants further downward away from the seat typically increases the exercise of the user's abdominal muscles. The incline and swiveling of the seatback thereby typically cause the abdominal muscles to be strengthened as the pedaling mechanism exercises the legs.

The connection mechanism is preferably implemented with a bar portion, a pair of cross-bar sleeves, and an axial sleeve. The bar portion is formed with a cross bar and an axial bar which extends generally along the axis of the connection mechanism and meets the cross bar between its ends to divide the cross bar into a pair of cross-bar portions. The cross-bar sleeves are connected to the frame or/and the seat and respectively receive the cross-bar portions for enabling the incline of the seatback to the seat to be adjusted. The axial sleeve is connected to the seatback and receives the axial bar for enabling the seatback to swivel about the axis of the connection mechanism. In addition, the connection mechanism preferably includes a support portion for adjusting the seatback-to-seat incline. The support portion is flexibly and/or adjustably connected to the axial bar or/and the seatback and is likewise flexibly and/or adjustably connected to the frame.

Another exercise machine in accordance with the invention contains a pedal-translating pedaling mechanism and a pair of handles. The pedaling mechanism has a pair of pedals that translate back and forth. The handles are situated relative to the pedals such that an average-size adult user of the machine is in a crouched or crouched-to-prone position when the user's feet respectively contact the pedals and the user's hands respectively hold the handles. In addition to exercising the user's legs, this exercise machine of the invention exercises the user's arms as the user's feet move the pedals.

A further exercise machine in accordance with the invention contains support structure and a handle-translating mechanism connectable to the support structure. The handle-translating mechanism has a pair of handles that generally translate back and forth. The support structure is suitable for receiving a user of the machine such that the user's hands can respectively grip the handles. By actuating the handles, the user exercises the user's arms. The exercise machine may include a pedaling mechanism having a pair of movable pedals. In that case, the user can exercise the user's legs by actuating the pedals with the user's feet.

Each of the present exercise machines may include a display for visually presenting exercise information that occurs during machine operation. For example, the readout display can provide the instantaneous cycling rate of the pedaling or handle-translating mechanism, the duration of an exercise period by a user actuating the pedaling or handle-translating mechanism, or/and an estimate of the caloric energy expended by the user during the exercise period.

The frame, seat, seatback, and connection mechanism form an exercise bench in accordance with the invention. The exercise bench typically includes one or more pairs of handles variously connected to the frame, the seat, the seatback, or/and the connection mechanism at generally symmetrical locations on opposite sides of the frame, the seat, the seatback, or/and the connection mechanism. A user can exercise on the bench with each of the pedaling and handle-translating mechanisms disconnected from the frame or simply without using any of the pedaling and handle-translating mechanisms.

BRIEF DESCRIPTION OF THE DRAWINGS

Like reference symbols are employed in the drawings and in the description of the preferred embodiments to represent the same, or very similar, item or items. All planes, axes, and reference lines are indicated in dashed line in the drawings.

DESCRIPTION OF THE PREFERRED EMBODIMENTS

Exercise Machines with Pedaling Mechanisms

Figure 1:
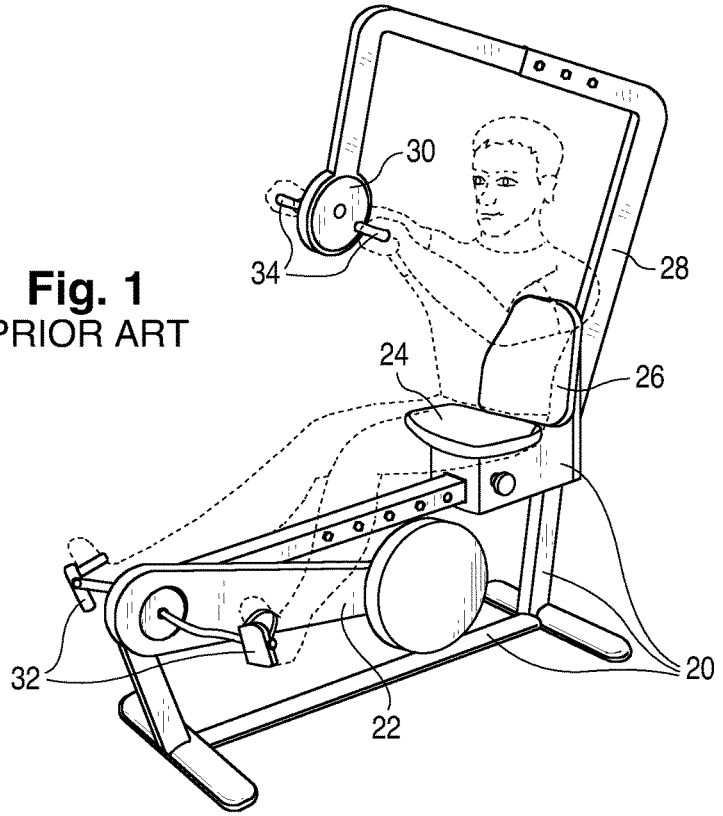
Fig. 1 PRIOR ART
FIG. 1 is a perspective view of a conventional multi-function exercise machine for exercising the legs and arms/shoulders of a user.
Figure 2A:
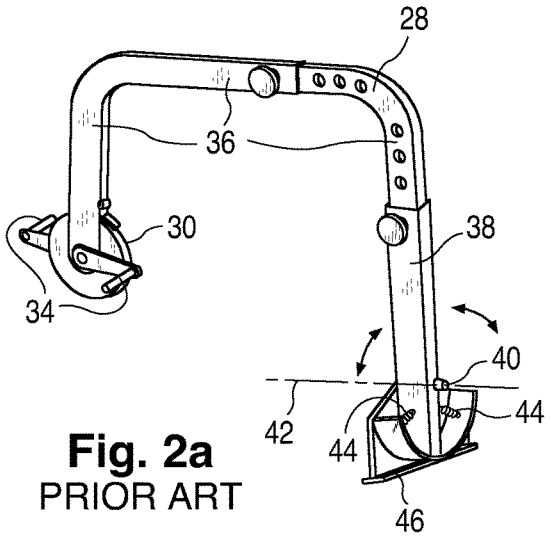
Fig. 2a PRIOR ART
FIGS. 2*a* and 2*b* are perspective views of two respective implementations of the upper-body assembly and rotational arm-shoulder device in the exercise machine of FIG. 1.
Figure 2B:
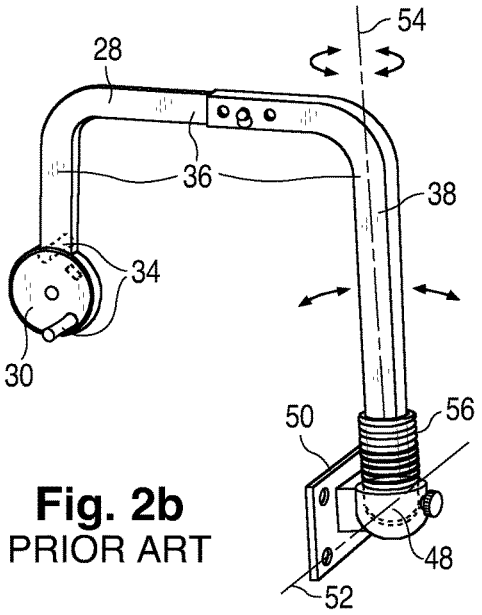
Fig. 2b PRIOR ART
Figure 3:
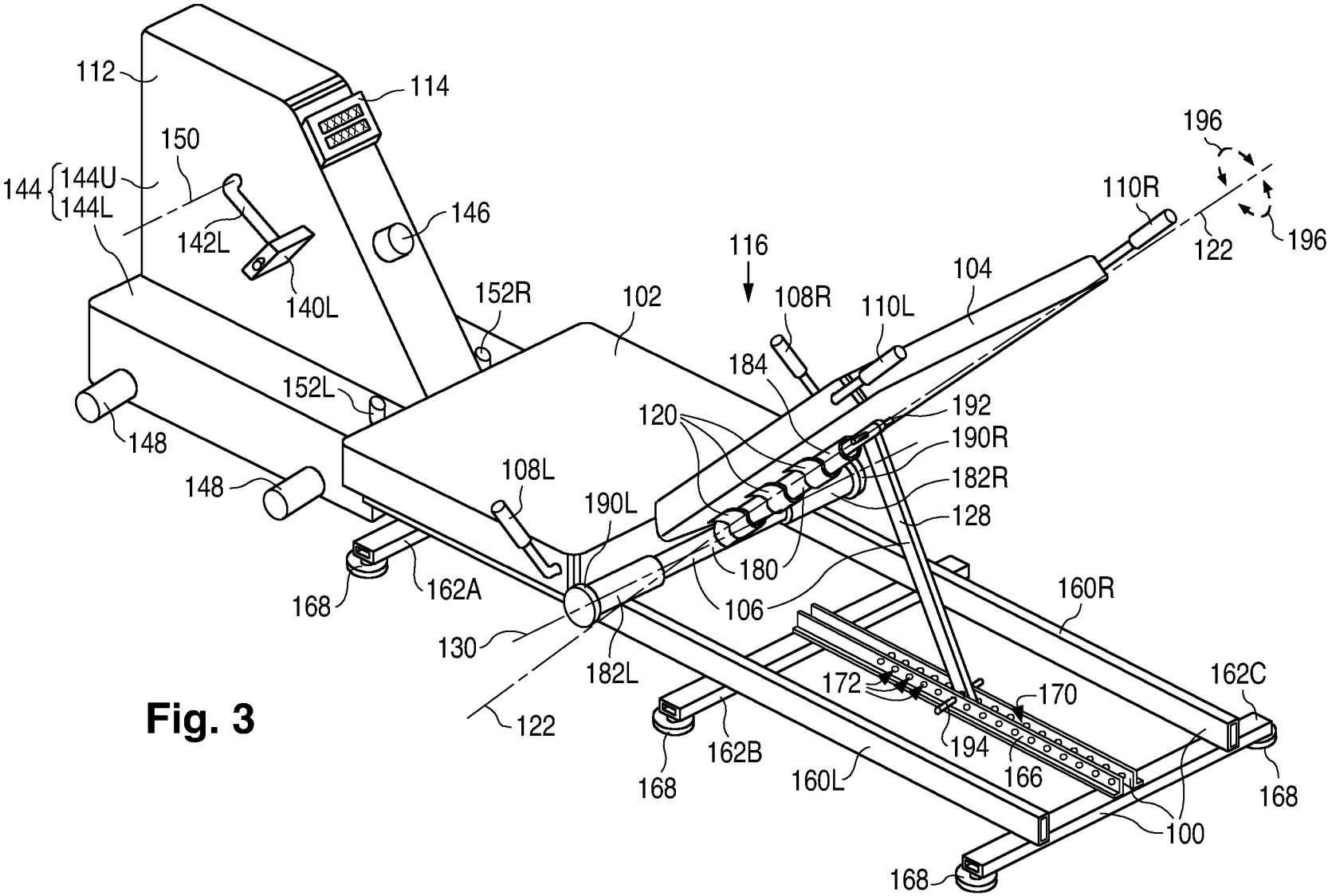
FIGS. 3-5 are respective perspective, side, and top views of a multi-function exercise machine configured according to the invention for exercising various muscles, including the legs and abdominal muscles, of a user.
Figure 4:
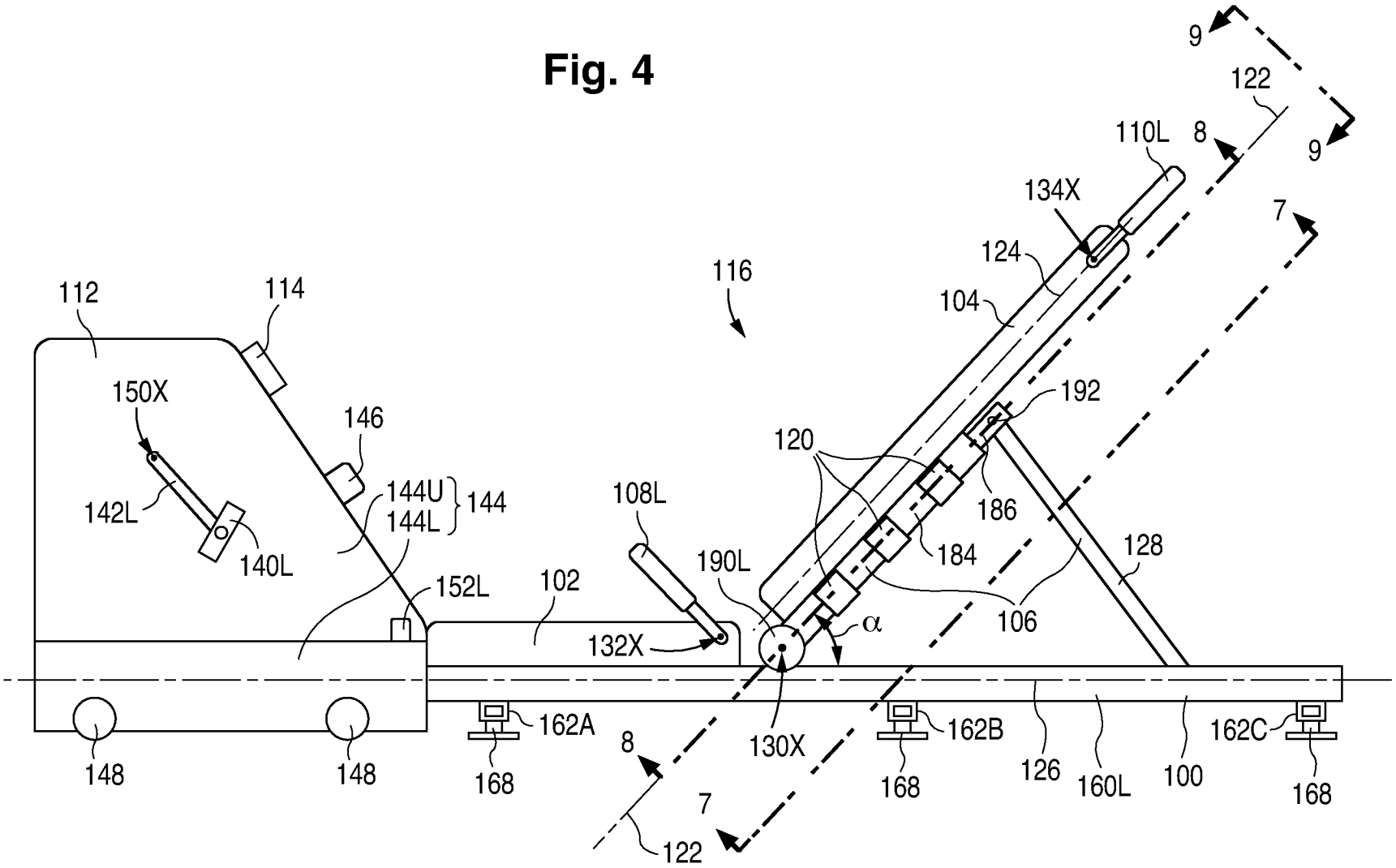
Figure 5:
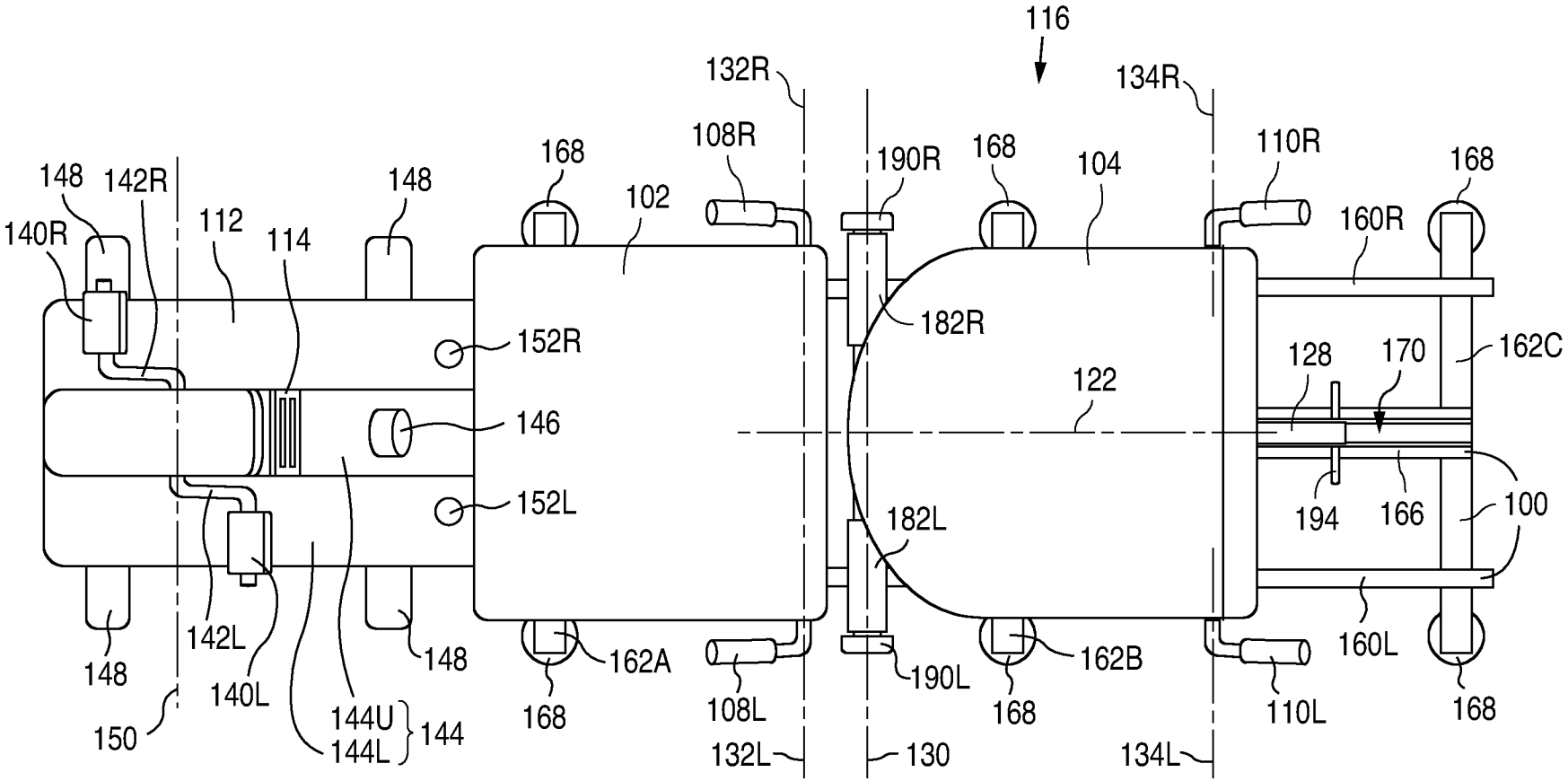

FIGS. 3-5 illustrate a multi-function exercise machine configured in accordance with the invention for enabling a user to exercise various muscles, including the user's legs and abdominal muscles. The exercise machine of FIGS. 3-5 consists of a frame 100, a generally rectangular seat 102, a seatback 104, a mechanism 106 for connecting seatback 104 to frame 100 or/and seat 102, a first pair of handles 108L and 108R (collectively "handles 108"), a second pair of handles 110L and 110R (collectively "handles 110"), a pedal-revolving pedaling mechanism 112, and a visual readout display 114. Frame 100, seat 102, seatback 104, seatback-to-frame/seat connection mechanism 106, first handles 108, and second handles 110 form a main assembly 116.

The length of the exercise machine of FIGS. 3-5, including the length of frame 100 and main assembly 116, is taken in the horizontal direction in FIG. 4. The width of the exercise machine, including the width of each of frame 100, seat 102, and seatback 104, is taken in the vertical direction in FIG. 5 and thus perpendicular to the plane of FIG. 4.

Seat 102 is fixedly mounted on frame 100 near the front end of frame 100. Seatback-to-frame/seat connection mechanism 106 is fixedly connected to frame 100 near the back edge of seat 102. Connection mechanism 106 can alternatively or additionally be connected to seat 102 along its back edge. In either case, seat 102 is situated laterally between connection mechanism 106 and pedal-revolving pedaling mechanism 112, Connection mechanism 106 includes a group of outwardly curved attachment brackets 120 that fixedly connect connection mechanism 106 to the back of seatback 104. Three attachment brackets 120 are so utilized in the example of FIGS. 3-5.

Seatback-to-frame/seat connection mechanism 106 has a swivel axis 122 that extends generally parallel to the longitudinal centerline 124 (see FIG. 4) of seatback 104 and thus generally perpendicular to the width of seatback 104. That is, swivel axis 122 extends generally parallel to the length of the torso of a typical user seated on seat 102 with the user's back lying generally flat against seatback 104. Consequently, swivel axis 122 lies in a vertical plane which extends approximately through the longitudinal centerline 124 of seatback 104 and thus also approximately through a machine reference line 126 (also see FIG. 4) that extends along the length of the exercise machine through its center widthwise.

FIGS. 3-5 depict the situation in which seatback 104 is inclined backward relative to seat 102. In particular, the incline angle $\alpha$ between swivel axis 122 and machine reference line 126 (again see FIG. 4) is between 0° and 90°. When so oriented, seatback 104 is often referred to here as being in the inclined position.

Connection mechanism 106 includes a support rod 128 which is adjustably and flexibly connected to frame 100 so that mechanism 106 can be turned about a connection axis 130 depicted in FIGS. 3 and. 5. Connection axis 130, whose location is indicated by dot 130X in FIG. 4, extends generally parallel to the width of the exercise machine and thus generally perpendicular to both machine reference line 126 and longitudinal centerline 124 of seatback 104. Connection axis 130 is close to the back of seat 102 and the bottom of seatback 104. This enables the incline of seatback 104 to seat 102 to be adjusted from an a value close to 0° to an a value in the vicinity of 90°. In other words, the seatback-to-seat incline can be varied between a position in which seatback 104 lies nearly flat on frame 100 and a position in which seatback 104 is nearly perpendicular to frame 100 and seat 102. As discussed further below, connection mechanism 106 is also configured so that seatback 104 can swivel (revolve, essentially rotate, through some angle) about swivel axis 122 as a user exercises with the machine of FIGS. 3-5.

First handles 108, referred to here generally as "seat" handles, are shown in FIGS. 3-5 as being received by seat 102 at generally opposite locations along the side (longitudinal) edges of seat 102 near its back edge and thus near the bottom of seatback 104. Seat handles 108 are preferably movable relative to seat 102. Alternatively, seat handles 108 can be received by frame 100 at corresponding opposite locations below the reception locations shown in FIGS. 3-5 near the back edge of seat 102. Seat handles 108 are then preferably movable relative to frame 100.

FIGS. 3-5 show second handles 110, referred to here generally as "seatback" handles, as being received by seatback 104 at generally opposite locations along the side (longitudinal) edges of seatback 104 near its top edge. Seatback handles 110 are preferably movable relative to seatback 104. Depending on the configuration of connection mechanism 106, seatback handles 110 can alternatively be received by connection mechanism 106 at corresponding generally opposite locations close to the reception locations shown in FIGS. 3-5. In that case, seatback handles 110 are preferably movable relative to connection mechanism 106.

Handles 108 and 110 can move in various ways. Seat handles 108L and 108R can be respectively turned about first handle axes 132L and 132R depicted in FIG. 5. First handle axes 132L and 132R, whose locations are generally indicated by dot 132X in FIG. 4, can be a common first handle axis extending generally parallel to the width of the exercise machine. Seat handles 108 can be rigidly connected together inside or below seat 102. Handles 108 then turn simultaneously (in synchronism) about the common first handle axis. Alternatively, handles 108L and 108R can be respectively turned about first handle axes 132L and 132R independently of each other. Handle axes 132 can then be inclined or/and slightly laterally offset from each other.

Similar comments apply to seatback handles 110. Seatback handles 110L and 110R can be respectively turned about second handle axes 134L and 134R depicted in FIG. 5. Second handle axes 134L and 134R, whose locations are generally indicated by dot 134X in FIG. 4, can be a common second handle axis extending generally parallel to the width of the exercise machine. Seatback handles 110 can be rigidly connected together inside or behind seatback 104. Handles 110 then turn simultaneously (in synchronism) about the common second handle axis. Alternatively, handles 110L and 110R can be respectively turned about second handle axes 134L and 134R independently of each other. In that case, handle axes 134 can be inclined or/and slightly laterally offset from each other.

Pedal-revolving pedaling mechanism 112 consists of a pair of foot pedals 140L and 140R (collectively "pedals 140"), a pair of pedal cranks 142L and 142R (collectively "cranks 142"), a cycle housing 144, an internal cycling apparatus (not shown) situated inside cycle housing 144, a resistance-adjustment knob 146 for adjusting the pedaling resistance, and a group of housing feet 148. Cycle housing 144 consists of a relatively high upper portion 144U and a wider lower portion 144L that provides pedaling mechanism 112 with mechanical stability. The longitudinal sides of lower housing portion 144L are approximately equidistant from the longitudinal sides of upper housing portion 144U.

Upper housing portion 144U has a slanted back surface on which resistance-adjustment knob 146 and readout display 114 are situated. Depending on the configuration of the internal cycling apparatus, resistance-adjustment knob 146 can alternatively be located on top of housing 144 or at some other suitable housing location readily accessible to a user. The slanting of the back surface of upper housing portion 144U makes it easy for the user to read readout display 114 while seated on seat 102.

Pedal cranks 142 are connected to the internal cycling apparatus of pedaling mechanism 112 through respective openings in the sides of upper housing portion 144U. Foot pedals 140L and 140R are respectively connected to pedal cranks 142L and 142R so as to allow each pedal 140L or 140R to rotate around a portion of that pedal's crank 142L or 142R. Another portion of each pedal crank 142L or 142R rotates around a pedaling axis 150 depicted in FIGS. 3 and 5. Pedaling axis 150, whose location is indicated by dot 150X in FIG. 4, extends generally parallel to the width of the exercise machine. As a result, pedals 140 revolve around pedaling axis 150.

The internal cycling apparatus of pedaling mechanism 112 can be implemented in various ways. Similar to what occurs in U.S. Pat. No. 6,902,515 B2 mentioned above, the internal cycling apparatus can include a flywheel and a pulley in which a belt runs around a pair of pulley wheels. One of the pulley wheels is connected to pedal cranks 142 so as rotate around pedaling axis 150. The other pulley wheel is connected center-to-center to the flywheel. When caused to rotate by the pulley, the flywheel provides cycling resistance. An internal extension of adjustment knob 146 can press on the belt to enable the cycling resistance to be adjusted by turning knob 146. The pulley wheel connected to pedal cranks 142 is typically of considerably greater diameter than the pulley wheel connected to the flywheel.

Housing feet 148 are implemented here as circular cylinders connected to the lower housing portion 144L along its lower surface so as to extend downward slightly farther than cycle housing 144. This implementation of housing feet 148 facilitates sliding housing 144 along the underlying surface. Pedaling mechanism 112 has four housing feet 148 in the example of FIGS. 3-5. Two of housing feet 148 are on each side of housing 144.

Pedaling mechanism 112 is adjustably connected to the front end of main assembly 116, specifically the front end of frame 100, as further described below in connection with FIG. 6 for enabling the distance from seat 102, e.g., the back edge of seat 102, to pedaling axis 150 to be adjusted in order to accommodate the size of the user. FIGS. 3-5 depict the situation in which pedaling mechanism 112 substantially touches seat 102 and thus the situation in which the distance from seat 102 to pedaling axis 150 is at a minimum value. Pedaling mechanism 112 and seat 102 are spaced apart from each other when the distance from seat 102 to pedaling axis 150 is adjusted to exceed the minimum value.

In the example of FIGS. 3-5, the distance from seat 102 to pedaling axis 150 is adjusted with a pair of knobs 152L and 152R (collectively "knobs 152") situated on lower housing portion 144L on opposite sides of upper housing portion 144U. Distance-adjustment knobs 152 are depicted in FIGS. 3-5 as being close to the back of pedaling mechanism 112 but, depending on how the seat-to-pedaling-axis distance is adjusted, can be closer to the front of pedaling mechanism 112. Depending on how the seat-to-pedaling-axis distance is adjusted, one or more devices other than distance-adjustment knobs 152 can be utilized to adjust the distance from seat 102 to pedaling axis 150.

Readout display 114 visually presents exercise information that occurs during operation of the exercise machine of FIGS. 3-5. Information provided by display 114 typically includes the instantaneous cycling rate, the duration of an exercise period by a user actuating pedaling mechanism 112, and the estimated caloric energy expended by the user during the exercise period. The instantaneous cycling rate is the number of pedaling cycles per unit time, typically per minute, where each cycle is a full revolution of either of pedals 140. Display 114 may present the total number of pedaling cycles during the exercise period. Display 114 may also present the user's pulse rate by way of a device (not shown) which can be attached to an appropriate part of the user's body to measure the user's pulse rate. The pulse-rate measuring device can be permanently or detachably connected to display 114.

One or more on/off switches (not separately shown) are provided on readout display 114 for enabling a user to control presentation of certain of the displayed exercise information. For instance, display 114 may present the duration of an exercise period and the user's estimated caloric energy expended during the exercise period only upon manually turning such an on/off switch on to start the exercise period. The on/off switch can later be manually turned off to stop the exercise period. The on/off switch may also automatically turn off when the instantaneous cycling rate has dropped substantially to zero for a selected period of time, e.g., 5-10 minutes. Display 114 may present the instantaneous cycling rate only when the on/off switch is turned on, or whenever the instantaneous cycling rate is significantly above zero, e.g., at least 5 cycles per minute, for a sufficiently long period, e.g., 10 seconds.

The top of seat 102 and the front of seatback 104 typically consist of leather or leather-like material. The insides of seat 102 and seatback 104 typically consist of cushion-like material formed with suitable foam or/and cotton.

Figure 6:
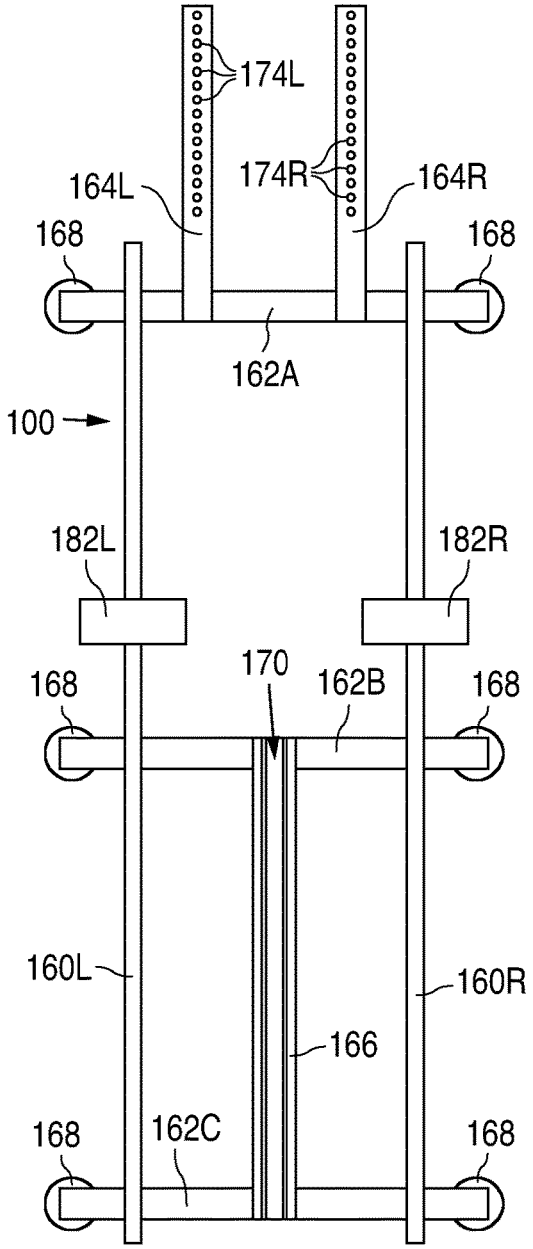
FIG. 6 is a top plan view of the frame in the exercise machine of FIGS. 3-5, FIGS. 11 and 12, or FIG. 17.

FIG. 6 particularly illustrates the layout of frame 100. As shown in FIGS. 3-6, frame 100 is an assembly consisting of two straight long longitudinal rails 160L and 160R (collectively "long rails 160") extending generally parallel to each other, three straight cross rails 162A, 162B, and 162C (collectively "cross rails 162") extending generally perpendicular to long rails 160, a pair of straight short longitudinal rails 164L and 164R (collectively "short rails 164") extending generally perpendicular to long rails 160, a straight channel portion 166 extending generally parallel to long rails 160, and six generally circular frame feet 168.

Long rails 160 are situated on, and rigidly connected to, cross rails 162 at spaced-apart locations along the length of frame 100 from front to back. Short rails 164 (only depicted in FIG. 6) are situated on, and rigidly connected to, front cross rail 162A at locations between long rails 160 and extend forward beyond long rails 160. As discussed below in connection with FIGS. 28, 29*a*, and 29*b*, short rails 164 can be flexibly connected to cross rail 162A so that they can be placed in a position in which they do not extend forward beyond long rails 160 when they are not connected to pedal-revolving mechanism 112 or any other such exercise mechanism. Channel portion 166 is situated on, and rigidly connected to, center cross rail 162B and back cross rail 162C at locations approximately mid-way between long rails 160. Two of frame feet 168 are connected to the bottom of each cross rail 162A, 162B, or 162C respectively close to its ends.

Rails 160, 162, and 164 typically consist of metal and are illustrated in FIGS. 3-5 as hollow but can be solid. Channel portion 166 likewise typically consists of metal and is shown in FIGS. 3, 5, and 6 as being formed with two members of L-shaped cross-section but can be a single member of U-shaped cross-section. In either case, channel portion 166 has an upward-extending channel 170. A plurality of pairs of oppositely situated horizontal circular openings 172 extend respectively through the side members of channel portion 166. As further described below, channel portion 166 acts as an interface to connection mechanism 106. The bottoms of frame feet 168 consist of rubber or/and rubber-like material that helps inhibit feet 168 from sliding on the underlying surface.

Frame 100 is preferably of approximately the following dimensions. Long rails 160 are 140-145 cm in length, 3 cm in width, and 5 cm in height. The spacing between long rails 160 is 35-40 cm. Cross rails 162 are 60 cm in length, 4 cm in width, and 3 cm in height. The distance between each consecutive pair of cross rails 162 is 55-65 cm. The distance from front cross rail 162A to the front ends of long rails 160 is 6-10 cm. The distance from back cross rail 162C to the back ends of long rails 160 is 2-4 cm. Short rails 164 are 40-45 cm in length, 4 cm in width, and 4 cm in height. As a result, short rails 164 typically extend forward 30-35 cm beyond the front ends of long rails 160. Channel portion 166 is 2-3 cm in width.

Standard mechanical connecting elements (not shown) such as bolts, nuts, and screws are used to connect rails 160, 162, and 164 and channel portion 166 to one another and to connect seat 102 to long rails 160. Metal-fusing techniques such as welding can be used in connecting components 160, 162, 164, and 166 to one another.

Short rails 164 respectively extend into a pair of openings (not shown) in the back of pedaling mechanism 112 for adjustably connecting mechanism 112 to the front end of frame 100 of main assembly 116 to accommodate the user's size, primarily the length of the user's legs. For use in making this adjustable connection, a plurality of vertical circular openings 174L situated generally in a line extend through short rail 164L. A like plurality of vertical circular openings 174R situated generally in a line extend through short rail 164R. Openings 174R are respectively situated substantially directly opposite openings 174L so that openings 174L and 174R (collectively "openings 174") are allocated into pairs of oppositely situated openings 174.

Distance-adjustment knob 152L (see FIGS. 3-5) is situated generally above the line of openings 174L in short rail 164L while distance-adjustment knob 152R (likewise see FIGS. 3-5) is situated generally above the line of openings 174R in short rail 164R. Knobs 152 have respective internal extensions (not shown) which respectively pass through a selected one of the pairs of oppositely situated openings 174 thereby connecting pedaling mechanism 112 to the front end of frame 100 of main assembly 116. The knob extensions also respectively pass through a pair of openings in an underlying piece of material rigidly connected to cycle housing 144 so as to make the connection solid.

The connection of pedaling mechanism 112 to the front end of main assembly 116 is adjusted by first pulling distance-adjustment knobs 152 sufficiently upward to release the connection. The depth to which short rails 164 extend into the openings in pedaling mechanism 112 is changed. Knobs 152 are then pushed downward so that the knob extensions respectively pass through another selected pair of oppositely situated openings 174 and through the two openings in the underlying piece of material connected to housing 144. In addition to being adjustably connected to main assembly 116, pedaling mechanism 112 can be readily disconnected from assembly 116 to facilitate storing the exercise machine of FIGS. 3-5 and to enable another exercise mechanism, such as that described below in connection with FIGS. 11-13 or in connection with FIG. 24, to be adjustably connected to the front end of assembly 116 via short rails 164.

Figure 7:
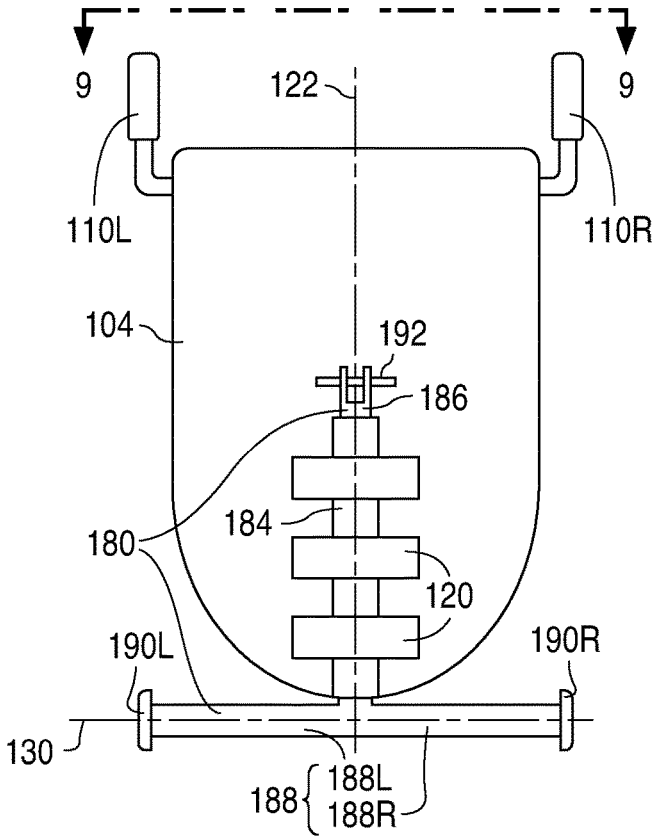
FIG. 7 is a backside plan view of the seatback and seatback-adjoining portion of the seatback-to-frame/seat connection mechanism in the exercise machine of FIGS. 3-5, FIGS. 11 and 12, or FIG. 17. The plan view of FIG. 7 is taken along plane 7-7 in FIGS. 4, 9, 12, and 17.
Figure 8:
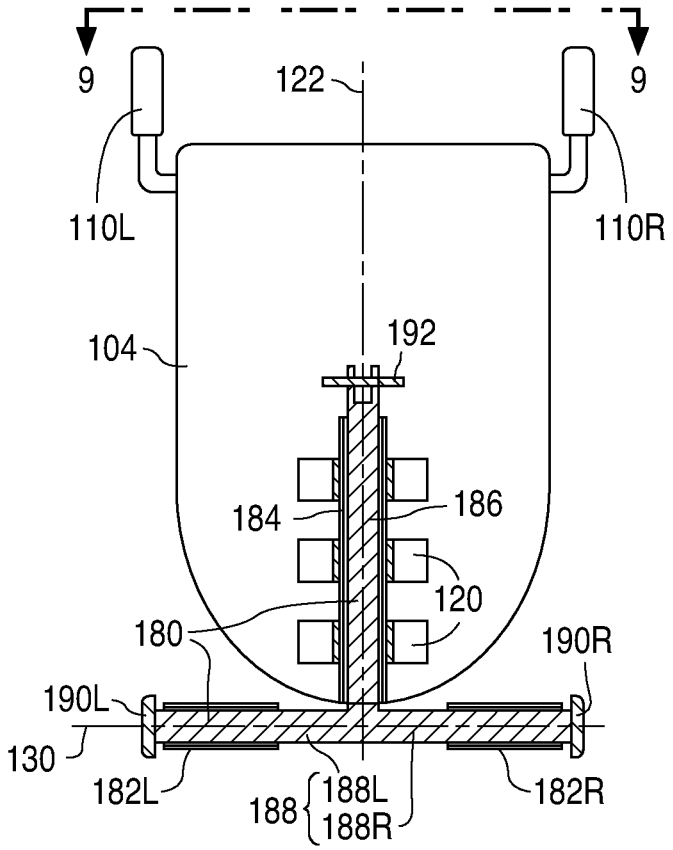
FIG. 8 is a cross-sectional plan view of the seatback and seatback-adjoining portion of the seatback-to-frame/seat connection mechanism in the exercise machine of FIGS. 3-5, FIGS. 11 and 12, or FIG. 17. The cross-sectional view of FIG. 8 is taken along plane 8-8 in FIGS. 4, 9, 12, and 17.
Figure 9:
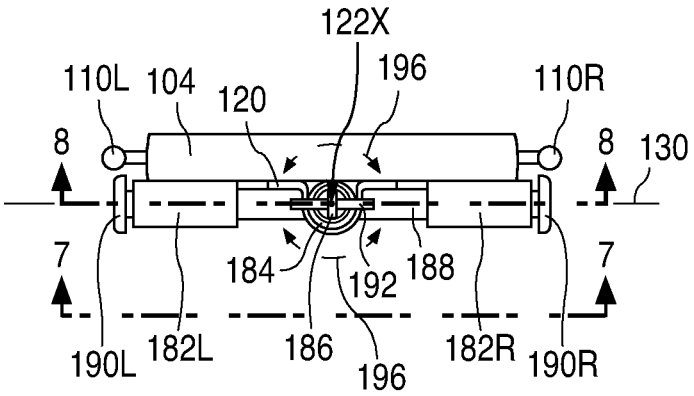
FIG. 9 is an end view of the seatback and seatback-adjoining portion of the seatback-to-frame/seat connection mechanism in the exercise machine of FIGS. 3-5, FIGS. 11 and 12, or FIG. 17. The end view of FIG. 9 is taken along plane 9-9 in FIGS. 4, 7, 8, 12, and 17.

FIGS. 7-9 particularly illustrate the structure of the seatback-adjoining portion of seatback-to-frame/seat connection mechanism 106 in conjunction with seatback 104. In addition to attachment brackets 120 and support rod 128, connection mechanism 106 includes a T-shaped bar portion 180, a pair of circular cylindrical cross-bar sleeves 182L and 182R (collectively "cross-bar sleeves 182"), and a circular cylindrical axial sleeve 184. T-shaped bar portion 180 is formed with a solid axial bar 186 extending generally along swivel axis 122, a solid circular cylindrical cross bar 188 extending generally along connection axis 130, and a pair of cross-bar end caps 190L and 190R. Axial bar 186 meets cross bar 188 between its ends to divide cross bar 188 into a pair of cross-bar portions 188L and 188R of approximately the same length. Cross-bar sleeves 182L and 182R are respectively rigidly connected, e.g., welded, to long rails 160A and 160B (see FIGS. 3 and 6) and respectively flexibly receive cross-bar portions 188L and 188R in such a way that cross bar 188 can turn, i.e., rotate through some angle less than 360°, in sleeves 182L and 182R and thus turn about connection axis 130.

Cross-bar end caps 190L and 190R respectively cover the ends of cross bar 188 as cross-bar portions 188L and 188R respectively just protrude out of cross-bar sleeves 182L and 182R. This acts to maintain longitudinal centerline 124 of seatback 104 and the longitudinal centerline of the seatback-adjoining portion of connection mechanism 106 in largely the same vertical plane as the longitudinal centerline of frame 100. Consequently, swivel axis 122 is in largely the same vertical plane as the longitudinal centerline of frame 100.

Axial sleeve 184 is rigidly connected to seatback 104 via attachment brackets 120. Axial bar 186 is circularly cylindrical for most of its length. Axial sleeve 184 flexibly receives axial bar 186 where it is cylindrical in such a way that axial sleeve 184 can turn, i.e., rotate through some angle less than 360°, around axial bar 186.

The remote end of axial bar 186, i.e., the end spaced apart from cross bar 188, splits into a pair of tines through which a pair of oppositely situated circular openings respectively extend. Letting the two ends of support rod 128 (see FIGS. 3 and 4) be respectively referred to as the seatback-associated end and the frame-associated end, a circular opening extends through the seatback-associated end of rod 128. With the seatback-associated end of support rod 128 positioned between the tines at the remote end of axial bar 186, support rod 128 is flexibly connected to axial bar 186 via a seatback-associated solid circular cylindrical pin 192 (especially see FIG. 3) that passes through the opening in the seatback-associated end of rod 128 and through the openings in the tines at the remote end of axial bar 186. Suitable movement-limiting elements (not shown), such as U bolts, cotter pins, or the like, are present at or near the ends of seatback-associated pin 192 to keep it permanently in place.

A circular opening also passes through the frame-associated end of support rod 128. The plurality of pairs of oppositely situated openings 172 in the side members of channel portion 166 of frame 100 define a like plurality of respectively corresponding frame-associated interface connection locations at which the frame-associated end of support rod 128 can be placed in channel 170. With the frame-associated end of support rod 128 placed at a selected one of those interface connection locations, support rod 128 is flexibly connected to channel portion 166 via a frame-associated solid circular cylindrical pin 194 (especially see FIG. 3) that passes through the opening in the frame-associated end of rod 128 and through the resulting selected pair of oppositely situated openings 172. Suitable movement-limiting elements (not shown), such as U bolts or the like, are present at or near the ends of frame-associated pin 194 to keep it in place during an exercise period. One of these movement-limiting elements can be readily removed by a person or, while the movement-limiting element stays in contact with pin 194, can be readily manipulated by a person for removing pin 194 from the exercise machine but otherwise prevents pin 194 from being removed from the machine during the exercise period.

Selection of a pair of oppositely situated openings 172 that receive frame-associated pin 194 establishes a particular value for the incline of seatback 104 to seat 102. The seatback-to-seat incline is adjusted by removing frame-associated pin 194 from the selected pair of openings 172 and from the opening in the frame-associated end of support rod 128, selecting another pair of oppositely situated openings 172, and then placing pin 194 through the new selected pair of openings 172 and through the opening in the frame-associated end of rod 128. This causes T-shaped bar portion 180 to turn about connection axis 130 by an angle typically no more than approximately 90°, thereby changing the seatback-to-seat incline defined quantitatively by angle $\alpha$ between swivel axis 122 and reference line 126. In particular, cross bar 188 extending along connection axis 130 turns in cross-bar sleeves 182L and 182R. Since the frame-associated end of support rod 128 can be flexibly connected to channel portion 166 at any one of the frame-associated interface connection locations defined by the pairs of oppositely situated openings 172, the frame-associated end of rod 128 is both flexibly and adjustably connected to channel portion 166. In addition, channel portion 166 acts as an interface portion of frame 100 for enabling the seatback-to-seat incline to be adjusted by selecting different ones of those interface locations.

With support rod 128 connected to interface channel portion 166 of frame 100, axial sleeve 184 of connection mechanism 106 can turn, i.e., rotate through some angle less than 360°, about axial bar 186 of T-shaped bar portion 180 and thus can similarly turn around swivel axis 122. The turning of axial sleeve 184 around axial bar 186 and swivel axis 122 is indicated by dashed-line curved arrows 196 in FIG. 3. In FIG. 9 where dot 122X indicates the location of swivel axis 122 because it extends perpendicular to the plane of the figure, curved arrows 196 also indicate how axial sleeve 184 can turn around axial bar 186 and swivel axis 122. One or more rings of ball bearings (not shown) can be inserted between axial bar 186 and axial sleeve 184 to facilitate the turning of sleeve 184 around bar 186. Since seatback 104 is rigidly connected to axial sleeve 184, seatback 104 can swivel about axial bar 186 and therefore also about swivel axis 122. Arrows 196 in FIGS. 3 and 9 also indicate the swiveling of seatback 104 about axial bar 186 and swivel axis 122.

The bottom edge of seatback 104 is shaped in such a way as to enable seatback 104 to swivel through a substantial angle about swivel axis 122 depending on the incline of seatback 104 to seat 102. The angle through which seatback 104 can swivel about swivel axis 122 generally increases as the seatback-to-seat incline, as measured by incline angle $\alpha$, increases. The maximum seatback swivel thus typically occurs when seatback 104 is approximately perpendicular to seat 102, i.e., incline angle $\alpha$ is approximately 90°. FIGS. 5, 7, and 8 illustrate the bottom edge of seatback 104 as being curved in a generally convex manner. However, the bottom edge of seatback 104 can be shaped in other ways for facilitating the seatback swivel.

Figure 10:
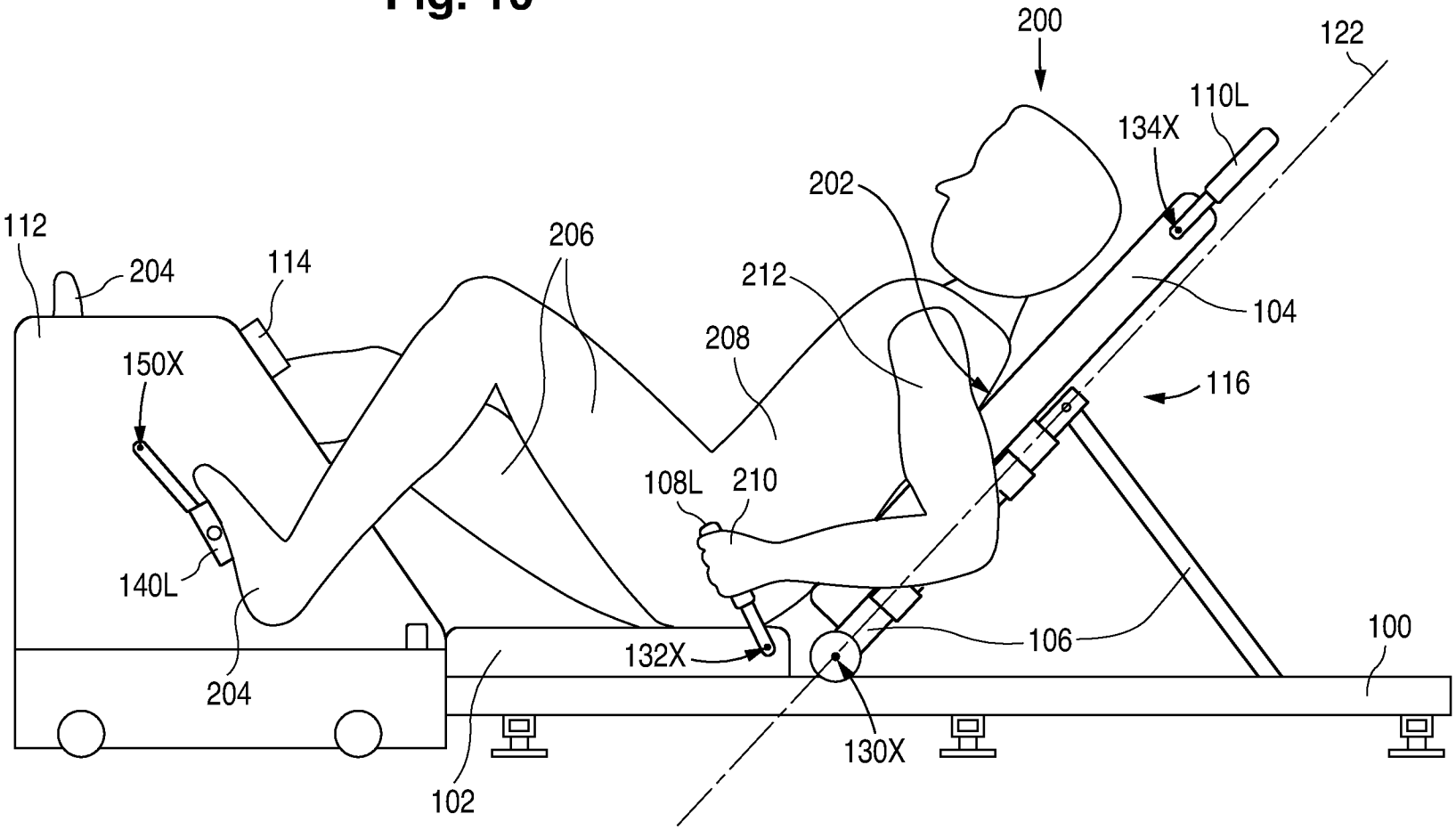
FIG. 10 is a side view of an example of how the exercise machine of FIGS. 3-5 is used according to the invention.

FIG. 10 presents an example of how a typical human adult 200 uses the multi-function exercise machine of FIGS. 3-5 to exercise in a seated exercise position. In this example, user 200 is seated on seat 102 with user's back 202 lying generally against seatback 104. With user's feet 204 respectively on foot pedals 140, user 200 pumps pedals 140 respectively with user's feet 204 to cause pedals 140 to revolve. This exercises user's legs 206. While exercising user's legs 206, user 200 can check readout display 114 for the various information presented on display 114, including an estimate of the caloric energy consumed by user 200 as a result of pumping pedals 140.

User 200 exercises the user's abdominal muscles by swiveling user's torso 208 about swivel axis 122 while user 200 is in the seated exercise position so as to cause seatback 104 to swivel about axis 122. The incline of seatback 104 to seat 102 is adjusted prior to an exercise period to adjust the exercise of the user's abdominal muscles during the exercise period. Reducing the seatback-to-seat incline so that seatback 104 slants further downward away from seat 102 typically increases the exercise of the user's abdominal muscles.

User 200 can pump foot pedals 140 at the same time that user's torso 208 swivels about swivel axis 122, thereby simultaneously exercising user's legs 206 and the user's abdominal muscles. Alternatively, user 200 can do only one of these two exercising actions during an exercise period.

User's hands 210 can be in various places. For example, user's hands 210 can respectively grip seat handles 108 as indicated in FIG. 10. This may facilitate pumping of foot pedals 140 by user's feet 204. User 200 can also move seat handles 108 with user's hands 210 to exercise user's arms 212. Alternatively, user's hands 210 can respectively grip seatback handles 110 to enhance swiveling user's torso 208 about swivel axis 122, thereby increasing the exercise of the user's abdominal muscles. User's hands 210 can, of course, grip other parts of the exercise machine or no part(s) of the machine.

Figure 11:
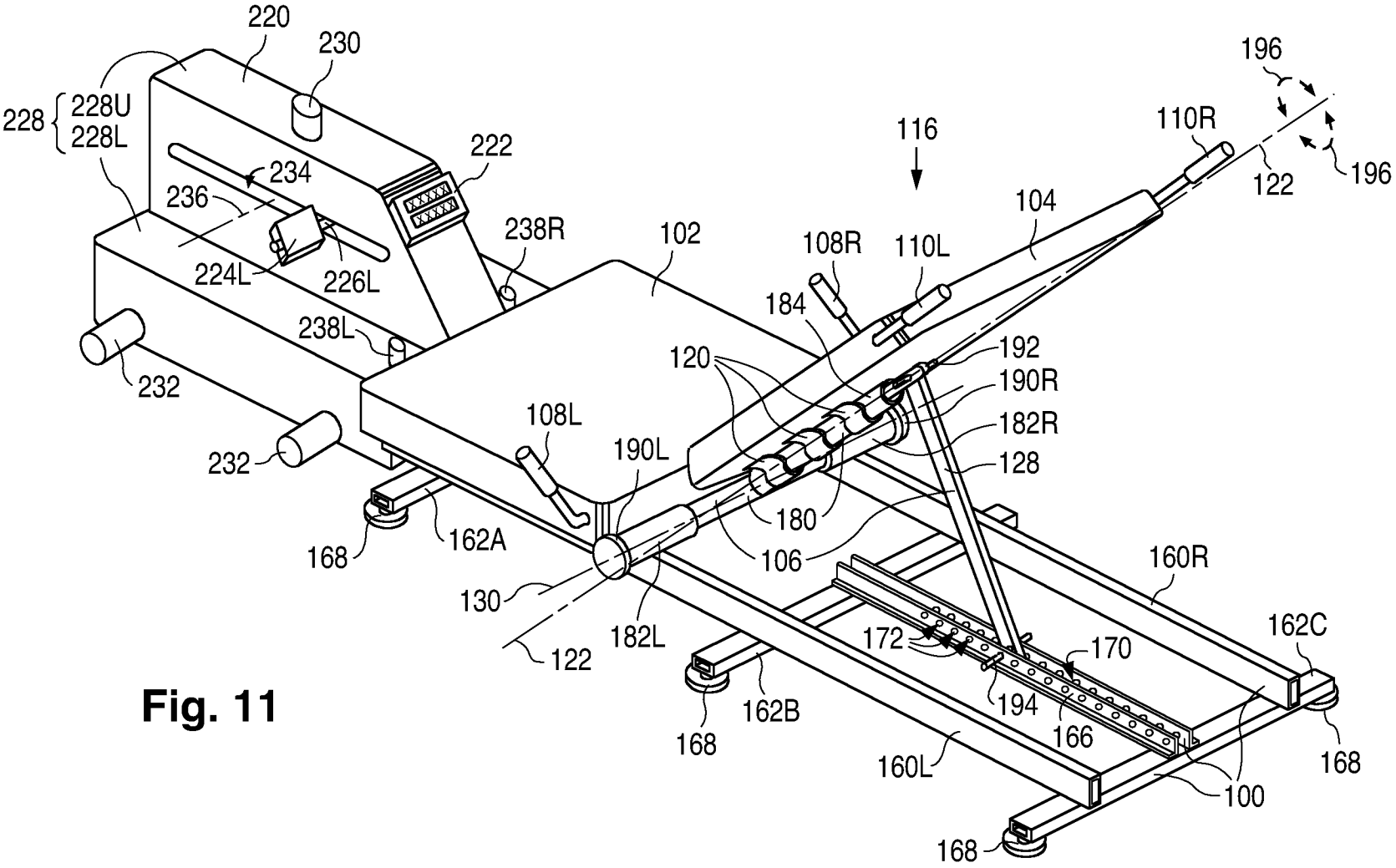
FIGS. 11 and 12 are respective perspective and side views of another multi-functional exercise machine configured according to the invention for exercising various muscles, including the legs and abdominal muscles, of a user.
Figure 12:
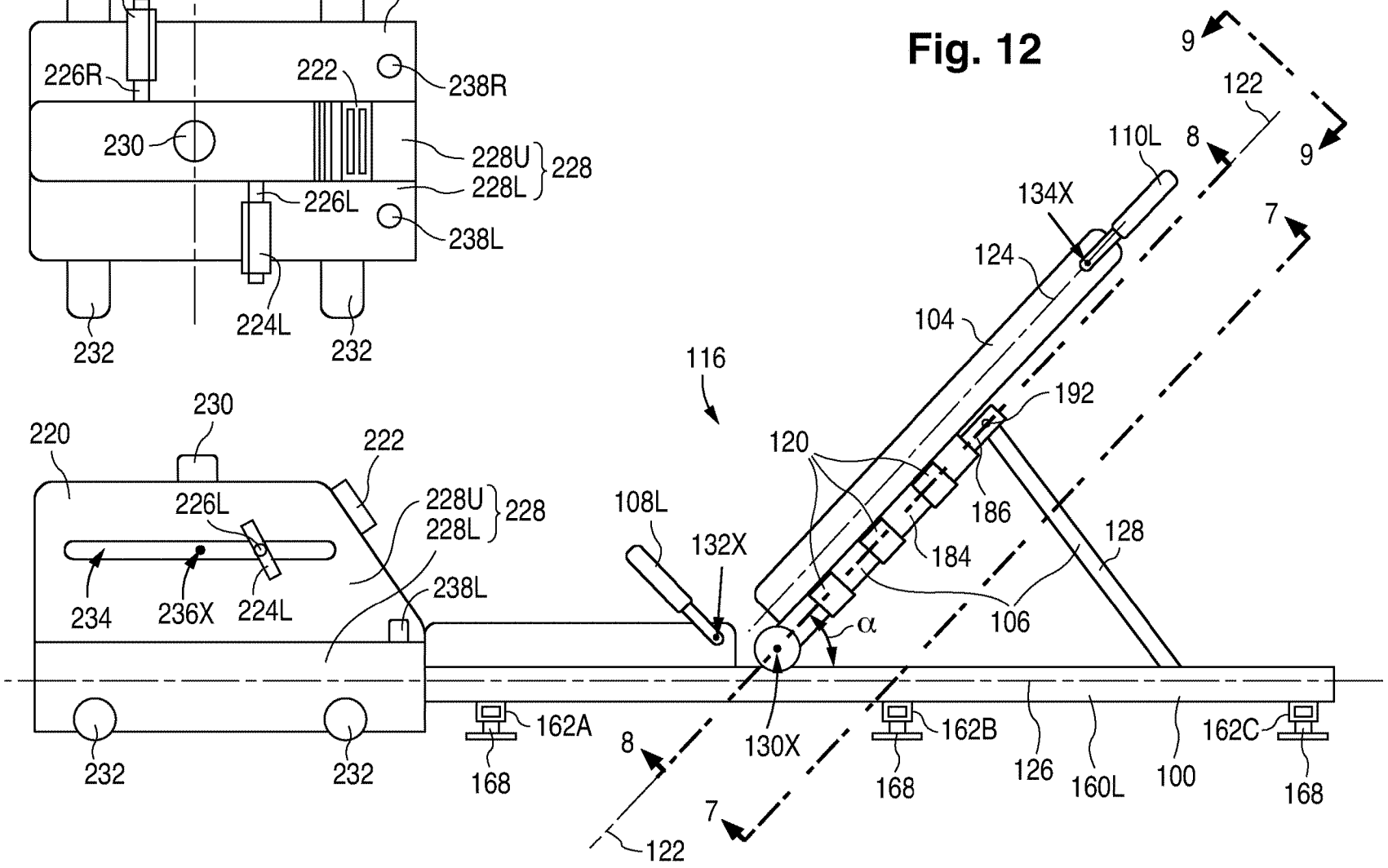

FIGS. 11 and 12 illustrate another multi-function exercise machine configured in accordance with the invention for enabling a user to exercise various muscles, including the user's legs and abdominal muscles. The exercise machine of FIGS. 11 and 12 consists of frame 100, seat 102, seatback 104, mechanism 106 for connecting seatback 104 to frame 100 or/and seat 102, seat handles 108, seatback handles 110, a pedal-translating pedaling mechanism 220, and a visual readout display 222. Frame 100, seat 102, seatback 104, seatback-to-frame/seat connection mechanism 106, and handles 108 and 110 in main assembly 116 of the exercise machine of FIGS. 11 and 12 are configured, interconnected, and operable the same as in the exercise machine of FIGS. 3-5. Readout display 222 in the machine of FIGS. 11 and 12 provides largely the same exercise information as readout display 114 in the machine of FIGS. 3-5. The two exercise machines differ in that pedal-translating mechanism 220 in the exercise machine of FIGS. 11 and 12 replaces pedal-revolving mechanism 112 in the exercise machine of FIGS. 3-5.

Figure 13:
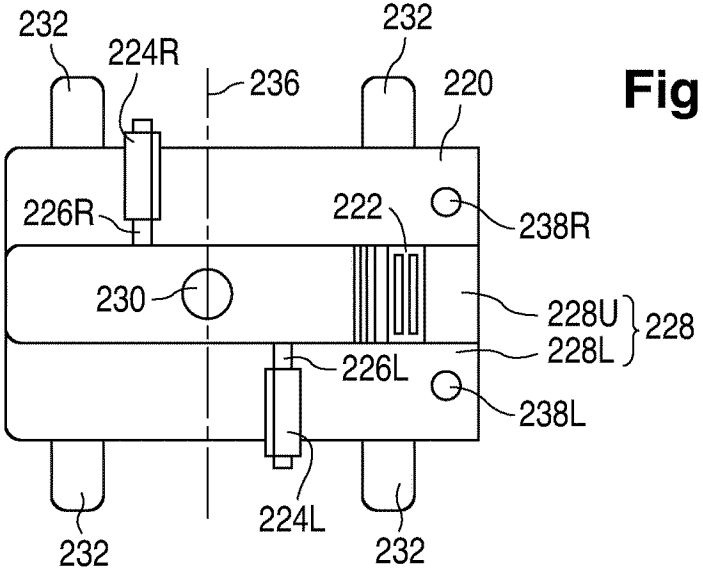
FIG. 13 is a top view of the pedal-translating mechanism in the exercise machine of FIG. 11.

Pedal-translating pedaling mechanism 220 is further illustrated in FIG. 13. With reference to FIGS. 11-13, pedaling mechanism 220 consists of a pair of foot pedals 224L and 224R (collectively "pedals 224"), a pair of pedal connectors 226L and 226R (collectively "connectors 226"), a translator housing 228, an internal translating apparatus (not shown) situated inside translator housing 228, a resistance-adjustment knob 230 for adjusting the pedaling resistance, and a group of housing feet 232. Translator housing 228 consists of an upper portion 228U and a wider lower portion 228L that provides pedaling mechanism 220 with mechanical stability. The longitudinal sides of lower housing portion 228L are approximately equidistant from the longitudinal sides of upper housing portion 228U.

Upper housing portion 228U has a slanted back surface on which readout display 222 is situated to make it easy for a user to read readout display 222 while the user is seated on seat 102. Resistance-adjustment knob 230 is situated on top of translator housing 228 but, depending on the configuration of the internal translator apparatus, can be located at some other suitable housing location readily accessible to the user.

Pedal connectors 226 are connected to the internal translating apparatus of pedaling mechanism 220 through two respective generally straight opposing connector slots 234 in the sides of upper housing portion 228U. Connector slots 234 typically extend largely in the longitudinal direction of the exercise machine of FIGS. 11 and 12, i.e., parallel to reference line 126, but can extend at a small angle to the exercise machine's longitudinal direction. Connector slots 234 are typically of largely the same length.

Foot pedals 224L and 224R are respectively connected to pedal connectors 226L and 226R so as to allow each pedal 224L or 224R to rotate around a portion of that pedal's connector 226L or 226R. Pedal connectors 226 translate (move linearly) back and forth in connector slots 234. Foot pedals 224 thereby translate back and forth in the direction of connector slots 234 within a distance range slightly less than the lengths of slots 234. More particularly, foot pedals 224 have a common center of mass that translates back and forth generally in a plane extending through connector slots 234. Each cycle of the instantaneous cycling rate presented on readout display 222 consists of a full back and forth translation of one of pedals 224.

Foot pedals 224 can translate back and forth in various ways. Pedals 224 are preferably controlled to operate in synchronism so that one of them translates back as the other translates forward. As measured from a position at which pedals 224 are directly opposite (and thus closest to) each other, the amounts (distances) of forward and backward translation are largely equal at any instant of time. In FIGS. 11 and 13, this pedal-opposing position is indicated by a translator reference line 236 extending parallel to the width of the exercise machine. Translator reference line 236, whose location is indicated by dot 236X in FIG. 12, normally lies in the plane through which the common center of mass of pedals 224 translates back and forth.

Foot pedals 224 can operate independently of each other. In that case, the internal translating apparatus of pedaling mechanism 220 may automatically causes pedals 224 to translate backward after they have translated forward and foot pressure on pedals 224 has been reduced sufficiently. Consequently, translator reference line 236 generally represents the neutral location for pedals 224 when they are directly opposite each other.

The internal translating apparatus of pedaling mechanism 220 can be implemented in various ways. In the preferred embodiment where foot pedals 224 operate in synchronism so that one of them translates back as the other translates forward, the internal translating apparatus can include a pulley arrangement that causes each pedal connector 226L or 226R to translate backward as the other pedal connector 226R or 226L translates forward. As measured from translator reference line 236 at which pedals 224 are directly opposite each other so that pedal connectors 226 are largely in line with each other, the pulley arrangement causes the amounts of forward and backward translation of pedal connectors 226 to be largely equal. An internal extension of resistance-adjustment knob 230 can press on a belt of the pulley arrangement to enable the translator resistance to be adjusted by turning knob 230.

As with housing feet 148 in the exercise machine of FIGS. 3-5, housing feet 232 are implemented here as circular cylinders connected to the lower housing portion 228L along its lower surface so as to extend downward slightly farther than translator housing 228. This implementation of housing feet 232 thereby facilitates sliding housing 228 along the underlying surface. Pedaling mechanism 220 has four housing feet 232 in the example of FIGS. 11-13. Two of housing feet 232 are on each side of housing 228.

Pedal-translating mechanism 220 is adjustably connected to the front end of frame 100 of main assembly 116 in the same manner as pedal-revolving mechanism 112 in the exercise machine of FIGS. 3-5. This enables the distance from seat 102 to translator reference line 236 in the exercise machine of FIGS. 11 and 12 to be adjusted in order to accommodate the size of the user. In particular, short rails 164 respectively extend into a pair of openings (not shown) in the back of pedaling mechanism 220. The distance from seat 102 to reference line 236 in the example of FIGS. 11 and 12 is adjusted with a pair of knobs 238L and 238R (collectively "knobs 238") situated on lower housing portion 228L on opposite sides of upper housing portion 228U typically close to the back of pedaling mechanism 220. Distance-adjustment knobs 238 have respective internal extensions and function the same as distance-adjustment knobs 152 in the exercise machine of FIGS. 3-5.

FIGS. 11 and 12 depict the situation in which pedaling mechanism 220 substantially touches seat 102 and thus the situation in which the distance from seat 102 to translator reference line 236 is at a minimum value. Pedaling mechanism 220 and seat 102 are spaced apart from each other when the distance from seat 102 to reference line 236 is adjusted to exceed the minimum value. Likewise analogous to pedal-revolving mechanism 112, pedal-translating mechanism 220 can be readily disconnected from main assembly 116 to enable another exercise mechanism, such as pedal-revolving mechanism 112 or that described below in connection with FIG. 24, to be connected to the front end of assembly 116 via short rails 164.

Figure 14:
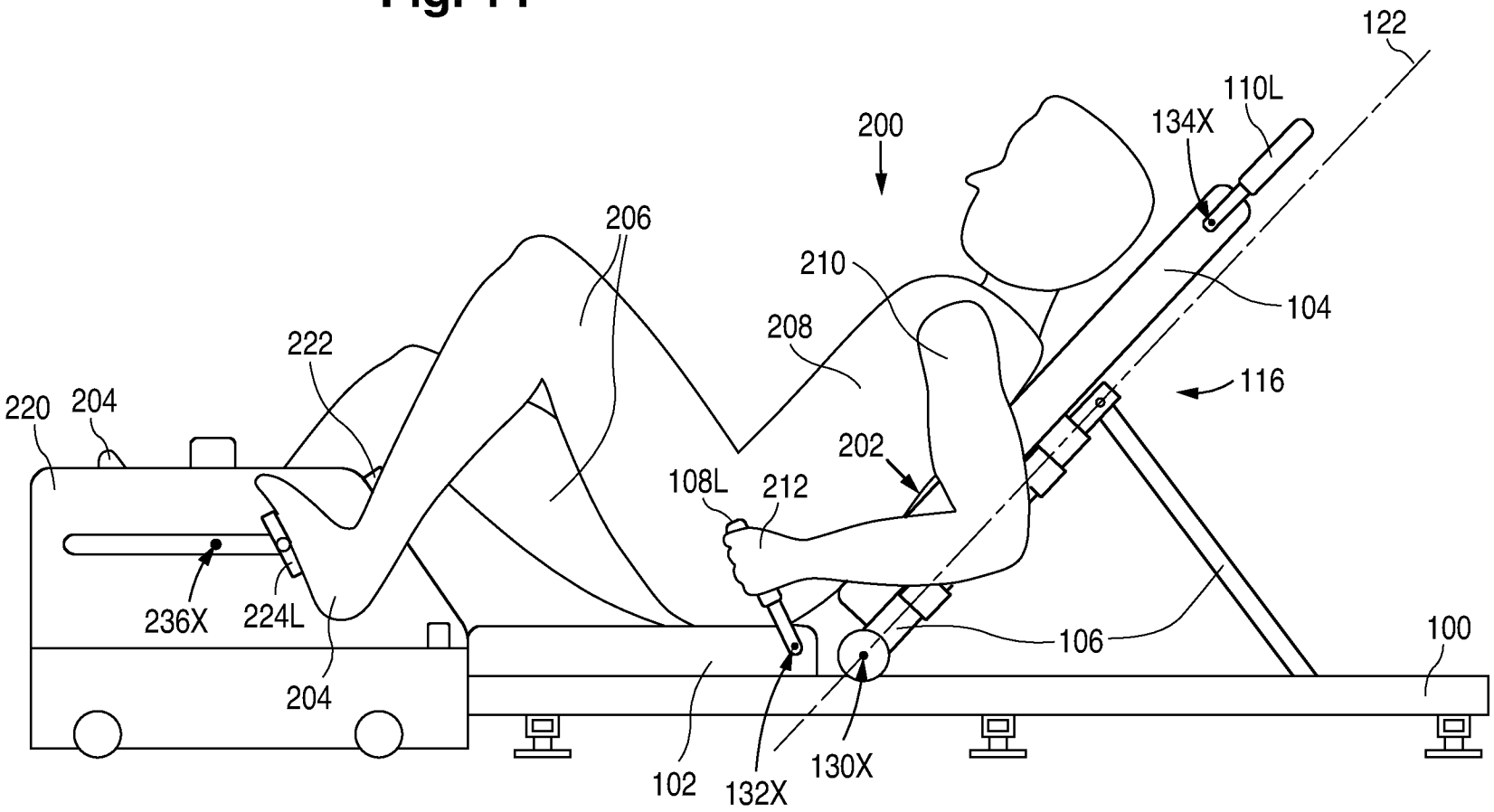
FIG. 14 is a side view of an example of how the exercise machine of FIGS. 11 and 12 is used according to the invention.

FIG. 14 presents an example of how human adult 200 uses the multi-function exercise machine of FIGS. 11 and 12 in a seated exercise position. As in the seated-position example of FIG. 10, user 200 in the example of FIG. 14 is seated on seat 102 so that user's back 202 lies generally against seatback 104. With user's feet 204 respectively on foot pedals 224, user 200 pumps pedals 224 respectively with user's feet 204 to cause pedals 224 to translate back and forth. User's legs 206 are thereby exercised. Exercise of other parts of the user's body, including the user's abdominal muscles, with the exercise machine of FIGS. 11 and 12 is performed in substantially the way described above in connection with FIG. 10 for the exercise machine of FIGS. 3-5.

Upon disconnecting the frame-associated end of support rod 128 from channel portion 166 of frame 100 in the exercise machine of FIGS. 3-5 or in the exercise machine of FIGS. 11 and 12, seatback 104 can be rotated backward so as to lie flat or nearly flat against frame 100 in order to reduce the space occupied by main assembly 116. When so oriented, seatback 104 is often referred to herein as being in the flat position. Placing seatback 104 in the flat position facilitates storage of the exercise machine. When support rod 128 is so disconnected from frame 100, the frame-associated end of rod 128 is normally moved backward so as to lie close to the back end of frame 100. Storage can be further facilitated by disconnecting pedaling mechanism 112 or 220 from main assembly 116.

In the earlier drawings depicting the exercise machines of the invention, seatback-to-frame/seat connection mechanism 106 was shown as extending significantly backward beyond the back of seatback 104 in order to facilitate visual illustration of the structure of connection mechanism 106. Alternatively, the axial section of the seatback-adjoining portion of connection mechanism 106 can be recessed partially or fully into the back of seatback 104. This enables seatback 104 to lie flatter against frame 100 when the frame-associated end of support rod 128 is disconnected from channel portion 166, and seatback 104 is rotated backward toward frame 100. Main assembly 116 then occupies even less space so as to further facilitate exercise machine storage, especially when pedaling mechanism 112 or 220 is disconnected from main assembly 116.

Figure 15A:
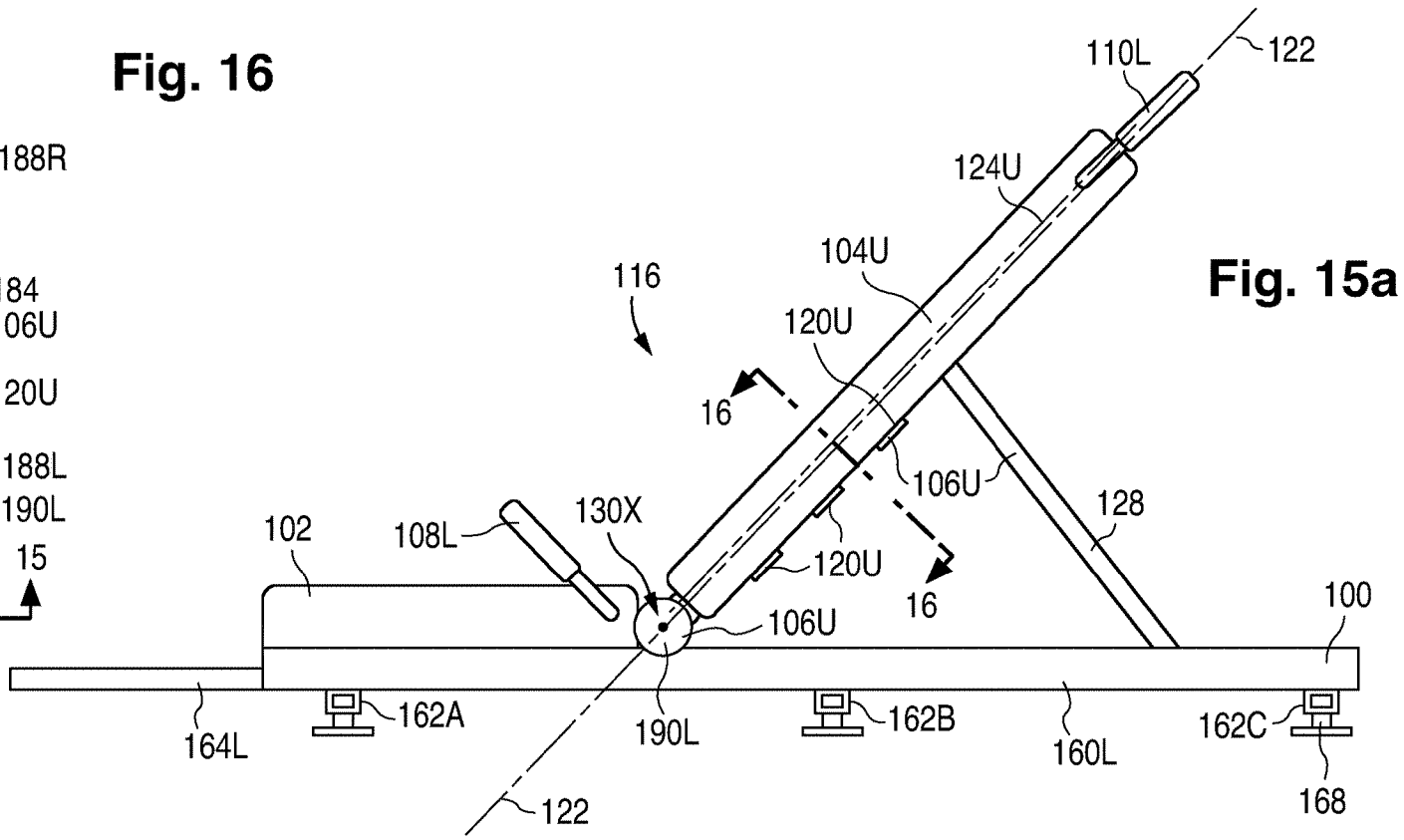
FIGS. 15*a* and 15*b* are side views of the main assembly (frame, seat, seatback, seatback-to-frame/seat connection mechanism, and handles) in the exercise machine of FIGS. 3-5, FIGS. 11 and 12, or FIG. 17 as implemented with an alternative embodiment of the seatback and seatback-to-frame/seat connection mechanism.
Figure 15B:
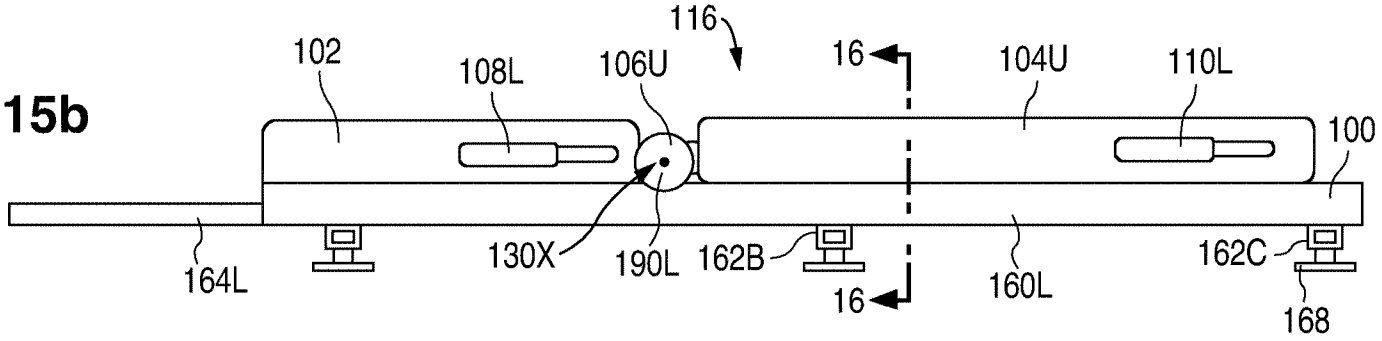
Figure 16:
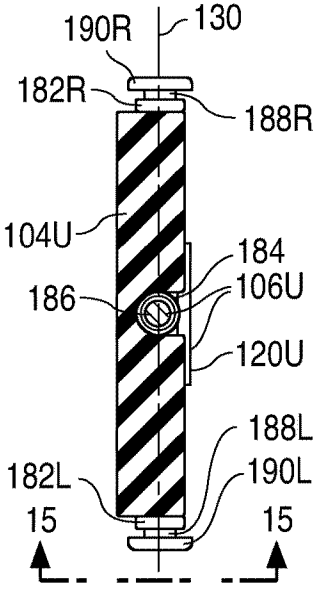
FIG. 16 is a cross-sectional end view of the seatback and seatback-adjoining portion of the seatback-to-frame/seat connection mechanism in FIGS. 15*a* and 15*b*. The cross-sectional view of FIG. 16 is taken along plane 16-16 in FIGS. 15*a* and 15*b*. The side views of the seatback and seatback-adjoining portion of the seatback-to-frame/seat connection mechanism of FIGS. 15*a* and 15*b* are taken along plane 15-15 in FIG. 16.

FIGS. 15*a* and 15*b* (collectively "FIG. 15") illustrate a version of main assembly 116 in which the axial section of the seatback-adjoining portion of a variation 106U of seatback-to-frame/seat connection mechanism 106 is, in accordance with the invention, recessed fully into the back of a variation 104U of seatback 104. FIG. 16 cross-sectionally illustrates seatback 104U and seatback-to-frame/seat connection mechanism 106U.

Seatback-to-frame/seat connection mechanism 106U is formed with support rod 128, T-shaped bar portion 180, cross-bar sleeves 182L and 182R, axial sleeve 184, pins 192 and 194, and a group of attachment brackets 120U corresponding to attachment brackets 120 in seatback-to-frame/seat connection mechanism 106U. As in connection mechanism 106, T-shaped bar portion 180 in connection mechanism 106U consists of axial bar 186, cross bar 188 formed with cross-bar portions 188L and 188R, and cross-bar end caps 190L and 190R. Components 182L, 182R, 184, 186, 188L, and 188R of connection mechanism 106U are visible in FIG. 16 but not in FIG. 15*a* or 15*b*.

The axial section of the seatback-adjoining portion of connection mechanism 106U consists of axial sleeve 184 and axial bar 186. As indicated in FIG. 16, axial section 184 and 186 of the seatback-adjoining portion of connection mechanism 106U is fully recessed into a channel in the back of seatback 104U. The channel in the back of seatback 104U typically extends up to its top edge. Attachment brackets 120U fixedly connect mechanism 106U, specifically axial sleeve 184, to the back of seatback 104U. In contrast to attachment brackets 120 which are curved outward to hold axial sleeve 184 against the back of seatback 104, attachment brackets 120U here are typically curved slightly inward but can be largely flat. Three attachment brackets 120U are shown in FIGS. 15*a* and 16. Due to the recessing of the axial section of the seatback-adjoining portion of connection mechanism 106U into seatback 104U, the longitudinal centerline 124U of seatback 104U is closer to swivel axis 122 than is longitudinal centerline 124 of seatback 104.

Aside from the differences just indicated, seatback 104U is configured largely the same as seatback 104. Consequently, the bottom edge of seatback 104U is shaped generally as shown in FIGS. 7 and 8 for seatback 104 to avoid inhibiting the swivel of seatback 104U about swivel axis 122. Support rod 128, T-shaped bar portion 180, cross-bar sleeves 182, axial sleeve 184, and pins 192 and 194 in connection mechanism 106U are respectively configured, interconnected, and operable the same as in connection mechanism 106.

FIG. 15*a* presents an example of how main assembly 116 appears when seatback 104U is in the inclined position. FIG. 15*b* shows how main assembly 116 appears when (a) seatback 104U is in the flat position and (b) the frame-associated end of support rod 128 has been disconnected from channel portion 166 (not visible in FIG. 15*b*) of frame 100. The top of seat 102 and the front of seatback 104U are largely coplanar. Support rod 128 (not visible in FIG. 15*b*) now lies in the portion of the seatback channel extending up to, or close to, the top edge of seatback 104U. Seat handles 108 and seatback handles 110 have been arranged in FIG. 15*b* to be no higher than the top of seat 102 and the front of seatback 104U. As FIG. 15*b* indicates, main assembly 116 is of relatively small height in this compressed position so as to facilitate storage of assembly 116.

Figure 17:
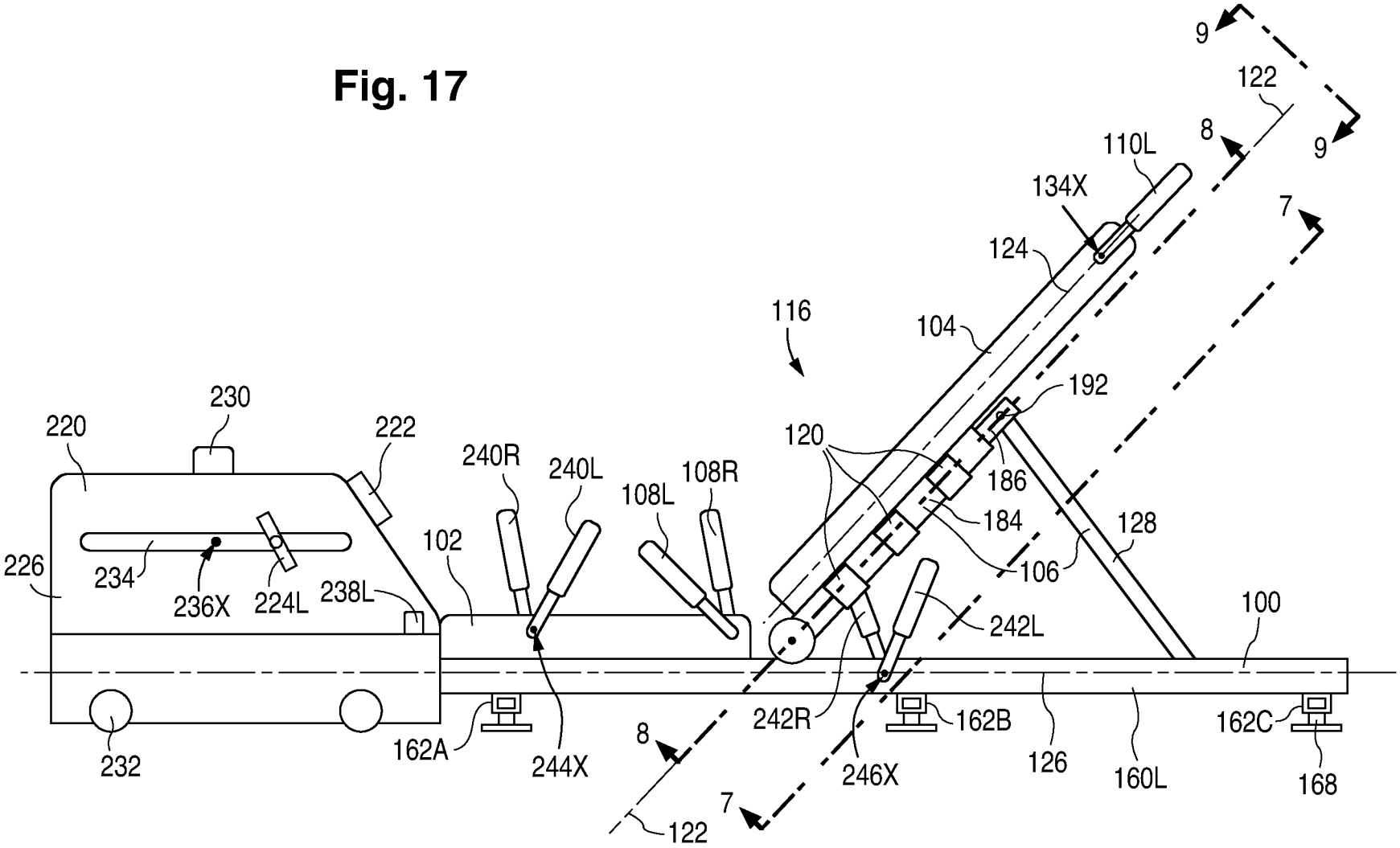
FIG. 17 is a side view of a variation, configured according to the invention, of the multi-function exercise machine of FIGS. 11 and 12.

FIG. 17 illustrates a multi-function exercise machine configured in accordance with the invention for exercising various muscles, including the legs, arms, and abdominal muscles, of a user using any of several different exercise positions. As a variation of the exercise machine of FIGS. 11 and 12, the exercise machine of FIG. 17 consists of frame 100, seat 102, seatback 104, seatback-to-frame/seat connection mechanism 106, seat handles 108, seatback handles 110, a third pair of handles 240L and 240R (collectively "handles 240"), a fourth pair of handles 242L and 242R (collectively "handles 242"), pedal-translating pedaling mechanism 220, and readout display 222. Frame 100, seat 102, seatback 104, connection mechanism 106, and handles 108 and 110 in main assembly 116 of the machine of FIG. 17 are respectively configured, interconnected, and operable the same as in the machine of FIGS. 11 and 12 subject to modification of main assembly 116 to receive third handles 240 and fourth handles 242.

Seatback 104 and connection mechanism 106 in main assembly 116 of the exercise machine of FIG. 17 can be respectively replaced with seatback 104U and connection mechanism 106U as described above in connection with FIGS. 15 and 16. In either case, the exercise machine of FIG. 17 can be used to exercise the legs and abdominal muscles of a user utilizing the seated exercise position generally shown in FIG. 14 as described above for the exercise machine of FIGS. 11 and 12.

Third handles 240, referred to here generally as "seat" handles, are shown in FIG. 17 as being received by seat 102 at generally opposite locations along the side edges of seat 102 near its front edge. Front seat handles 240 are preferably movable relative to seat 102. Alternatively, frame 100 can receive seat handles 240 at corresponding opposite locations below the reception locations shown in FIG. 17 near the front edge of seat 102. In that case, seat handles 240 are preferably movable relative to frame 100.

Fourth handles 242, referred to here generally as "frame" handles, are shown in FIG. 17 as being received by frame 100 at generally opposite locations respectively along the longitudinal side edges of long rails 160 roughly halfway along their length. Long rails 160 can alternatively respectively receive frame handles 242 along the top edges of rails 160, again roughly halfway along their length. In either case, frame handles 242 are located longitudinally somewhat beyond the back edge of seat 102. Frame handles 242 are preferably movable relative to frame 100.

Similar to what was said above about handles 108 and 110, handles 240 and 242 can move in various ways. Front seat handles 240 can be respectively turned about a pair of third handle axes whose location is generally indicated by dot 244X in FIG. 17. The third handle axes can be a common third handle axis extending generally parallel to the exercise machine width. Seat handles 240 can be rigidly connected together inside or below seat 102. Handles 240 then turn simultaneously (in synchronism) about the common third handle axis. Alternatively, handles 240 can be respectively turned about the third handle axes independently of each other as generally indicated in FIG. 17. The third handle axes can then be inclined or/and slightly laterally offset from each other.

Frame handles 242 can be respectively turned about a pair of fourth handle axes whose location is generally indicated by dot 246X in FIG. 17. The fourth handle axes can be a common fourth handle axis extending generally parallel to the width of the exercise machine. Frame handles 242 can be rigidly connected together so that they turn simultaneously (in synchronism) about the common fourth handle axis. Instead, handles 242 can be respectively turned about the fourth handle axes independently of each other as generally indicated in the example of FIG. 17. Accordingly, the fourth handle axes can be inclined or/and slightly laterally offset from each other.

As mentioned above, the common center of mass of foot pedals 224 translates back and forth generally in a plane extending in the direction of, and passing through, connector slots 234. This plane is typically nearly horizontal when the exercise machine of FIG. 17 is on a horizontal surface. In any event, most of each of frame handles 242 is normally below this plane when pedal-translating pedaling mechanism 220 is oriented such that this plane is nearly horizontal. The same applies to front seat handles 240 and also to back seat handles 108.

Figure 18:
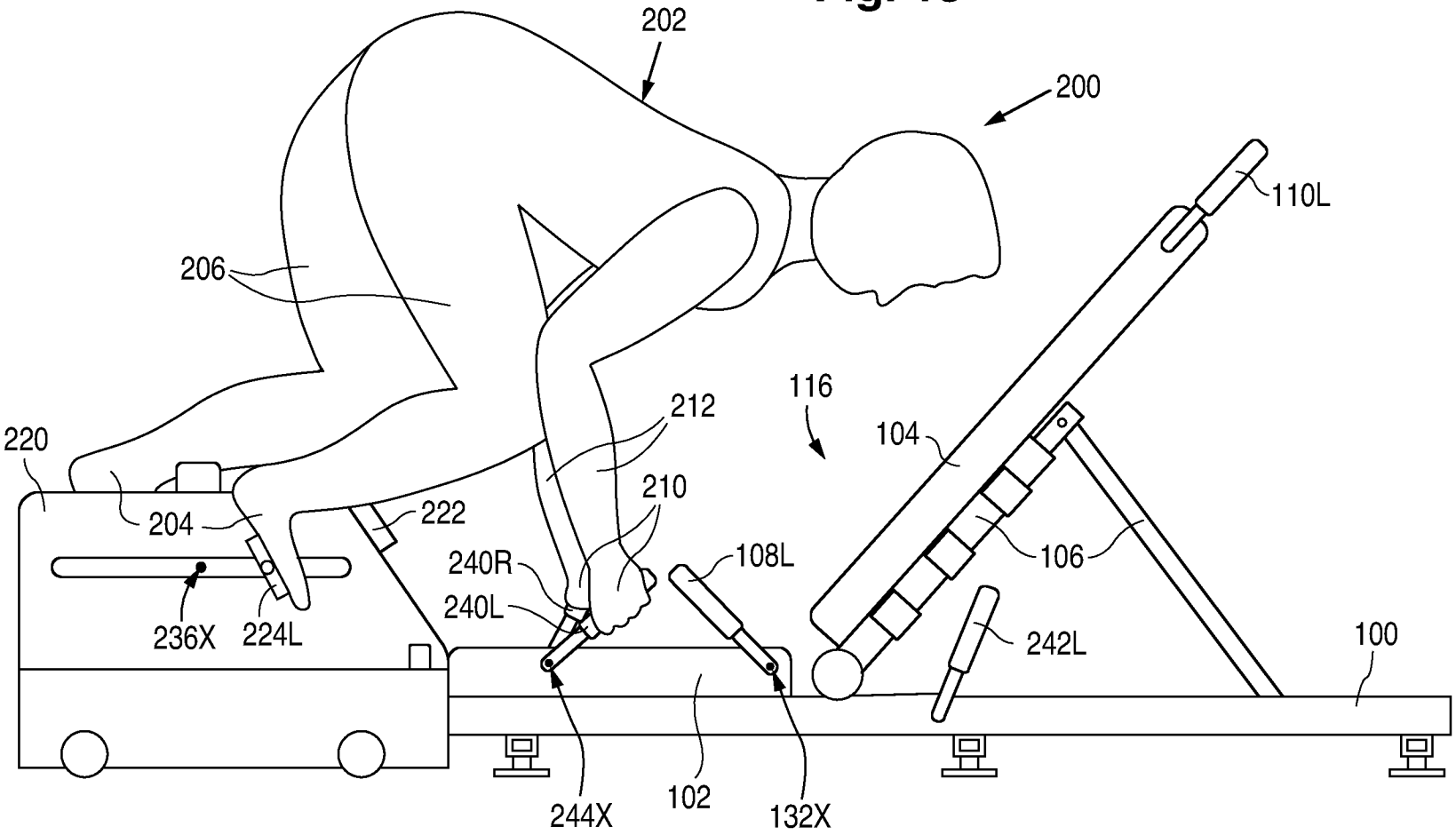
FIGS. 18 and 19 are side views of two respective examples of how the exercise machine of FIG. 17 is used according to the invention.

FIG. 18 presents an example of how typical human adult 200 uses the multi-function exercise machine of FIG. 17 to exercise in a crouched exercise position. User's hands 210 respectively grip front seat handles 240. User's feet 204 are placed respectively on foot pedals 224 so that user 200 is crouched with user's back 202 directed (facing) generally upward.

Front seat handles 240 are situated at a suitable average distance to foot pedals 224 such that user 200 is in the indicated severe crouch when user 200 is an average-size adult. This average distance is largely the distance from translator reference line 236, indicated by dot 236X in FIG. 17, to the third handle axes, generally indicated by dot 244X in FIG. 17. By appropriately adjusting the connection of pedaling mechanism 220 to frame 100, the average distance from pedals 224 to seat handles 240 can be adjusted to accommodate the size of user 200. FIGS. 17 and 18 depict the situation in which pedaling mechanism 220 substantially touches seat 102 and thus the situation in which the average distance from pedals 224 to seat handles 240 is at a minimum value. Pedaling mechanism 220 and seat 102 are spaced apart from each other when the average distance from pedals 224 to seat handles 240 is adjusted to exceed the minimum value.

User 200 pumps foot pedals 224 with user's feet 204 in the exercise position of FIG. 18 to cause pedals 224 to translate back and forth, thereby exercising user's legs 206. The accompanying movement of the user's body and the weight placed on user's arms 212 exercises user's arms 212. User 200 can move front seat handles 240 to maintain the user's balance and to further exercise user's arms 212. User 200 can look downward and backward (relative to the user's position on the exercise machine) to check readout display 222 in order to see the exercise information occurring during the exercise period.

Rather than gripping front seat handles 240, user's hands 210 can grip back seat handles 108 while user 200 is generally in the crouched position with user's feet 204 on foot pedals 224 and with user's back 202 generally directed upward. As another alternative, user's hands 210 can variously grip, e.g. switch back and forth between, seat handles 108 and 240. Exercising from the crouched position of FIG. 18 exercises largely all of the user's major muscle groups, including the user's abdominal muscles.

Figure 19:
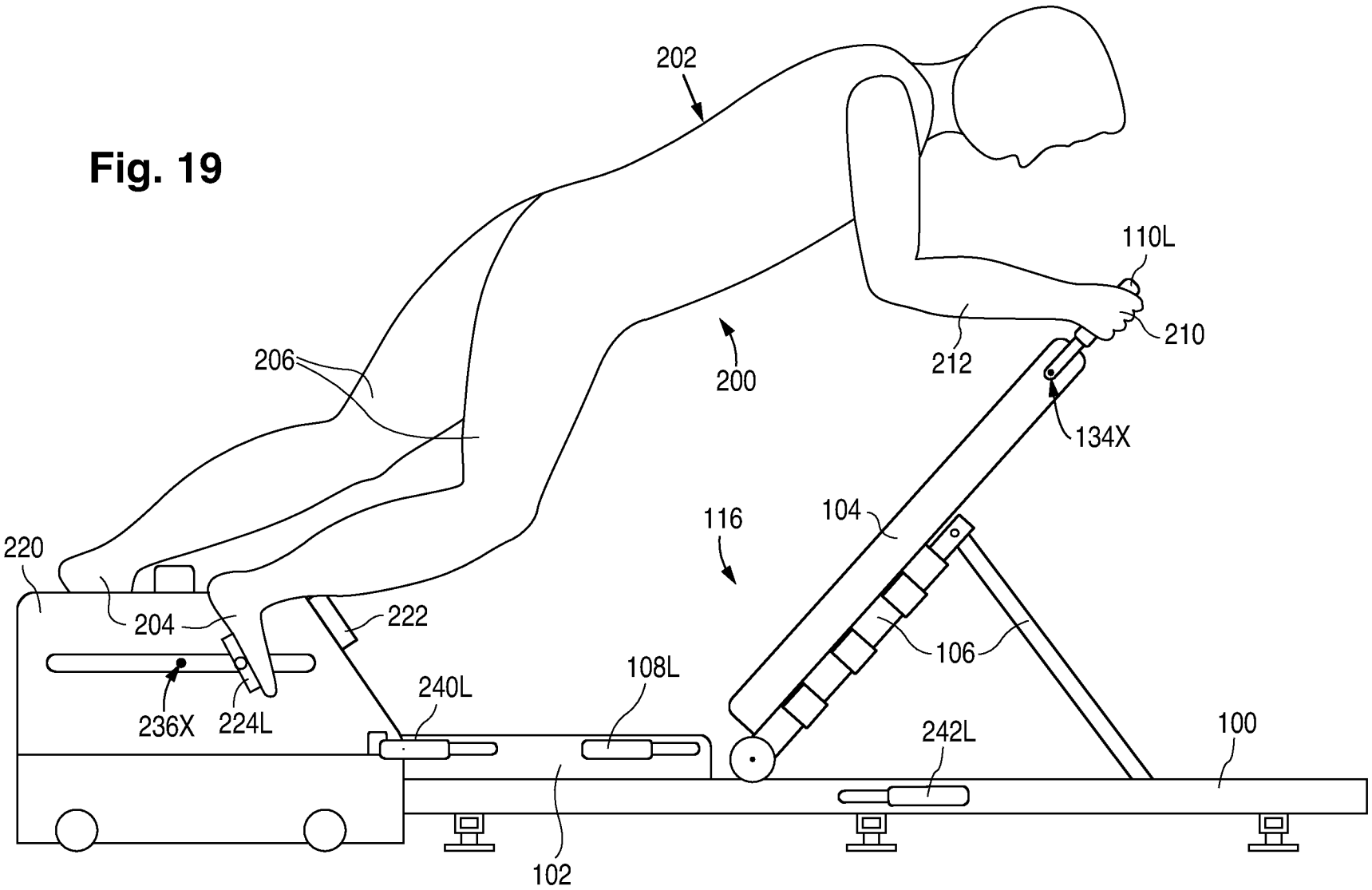

FIG. 19 presents an example of how human adult 200 uses the exercise machine of FIG. 17 to exercise in a largely prone, typically somewhat slanted, exercise position. Seatback 104 is set at a suitable incline relative to seat 102. As necessary, the connection of pedaling mechanism 220 to frame 100 is adjusted so that the average distance from foot pedals 224 to seatback handles 110 is suitable for enabling user 200 to be in the indicated largely prone exercise position. This average distance is largely the distance from translator reference line 236, indicated by dot 236X in FIG. 19, to the second handle axes, generally indicated by dot 134X in FIG. 19.

User's hands 210 respectively grip seatback handles 110 for the exercise position of FIG. 19. User's feet 204 are placed respectively on foot pedals 224 so that user 200 is largely prone, i.e., user's back 202 is directed largely upward. The user's body is relatively straight but, depending on the incline of seatback 104 to seat 102 and on the distance from pedals 224 to seatback handles 110, is typically slanted somewhat relative to the surface below the exercise machine.

In the prone exercise position of FIG. 19, user 200 exercises user's legs 206 by pumping foot pedals 224 with user's feet 204 to cause pedals 224 to translate back and forth. User's arms 212 are simultaneously exercised due to the movement of the user's body and the weight/stress placed on user's arms 212 to maintain the prone position. User 200 can move seatback handles 110 to maintain the user's balance and to further exercise user's arms 212. Exercising from the prone position of FIG. 19 exercises largely all of the user's major muscle groups, including the user's abdominal muscles. User 200 can again look downward and backward to check readout display 222. Insofar as front seat handles 240 and frame handles 242 are not used, exercising from the prone position of FIG. 19 can also be done on the exercise machine of FIGS. 11 and 12.

FIGS. 18 and 19 and depict situations in which exercise is performed with seatback 104 in the inclined position. Instead seatback 104 can be in the flat position as generally indicated in FIG. 15*b* for seatback 104U. This can be facilitated by substituting seatback 104U and connection mechanism 106U of FIGS. 15 and 16 for seatback 104 and connection mechanism 106 in the exercise machine of FIG. 17.

Figure 20:
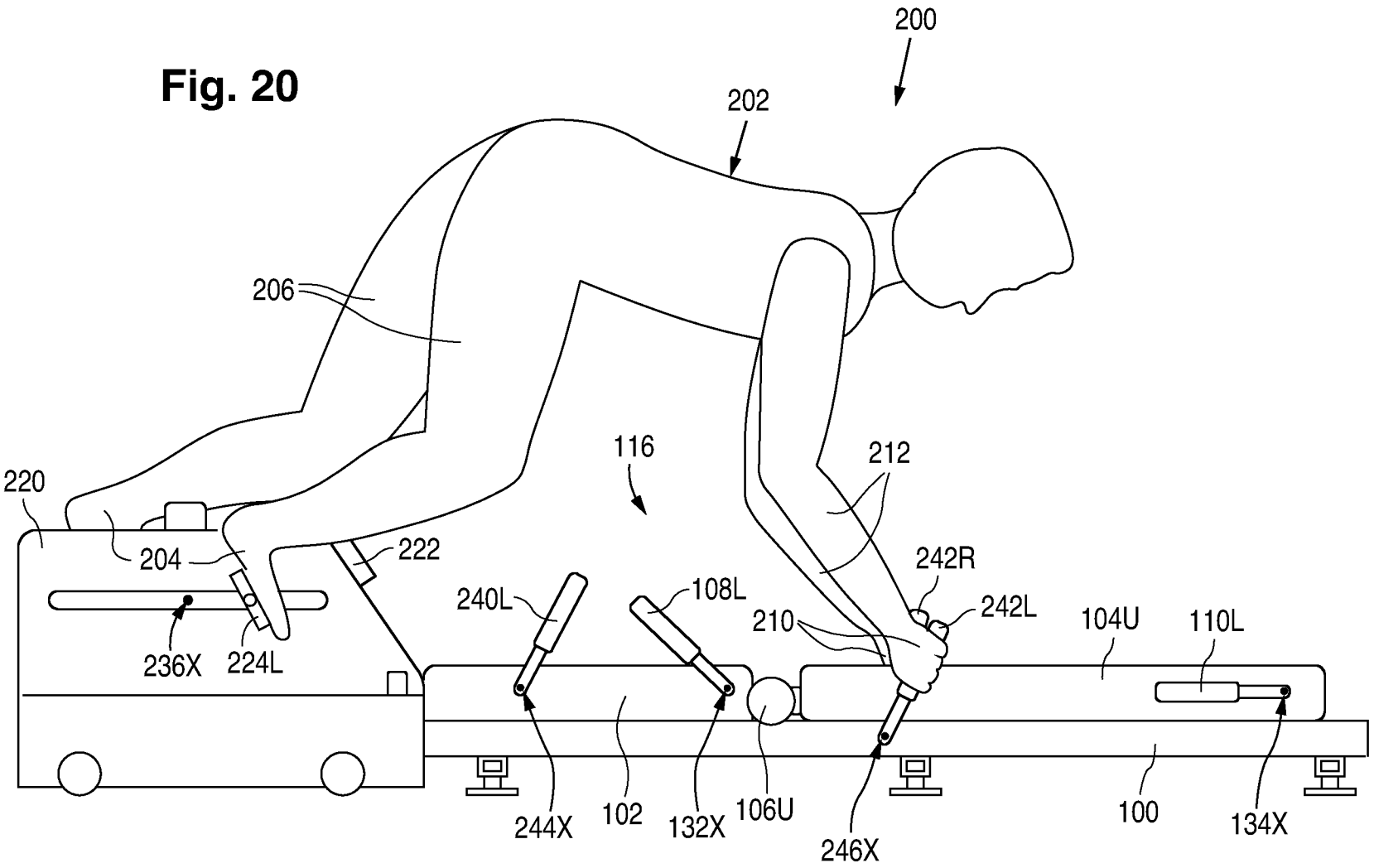
FIG. 20 is a side view of a further example of how the exercise machine of FIG. 17, as implemented with the alternative embodiment of the seatback and seatback-to-frame/seat connection mechanism of FIGS. 15*a* and 15*b*, is used according to the invention.

FIG. 20 presents an example of how human adult 200 uses the exercise machine of FIG. 17, as implemented with seatback 104U and connection mechanism 106U of FIGS. 15 and 16, to exercise in a crouched-to-prone exercise position with seatback 104U in the flat position. The connection of pedaling mechanism 220 to frame 100 is adjusted, as necessary, so that the average distance from foot pedals 224 to frame handles 242 is suitable for enabling user 200 to be in the indicated crouched-to-prone exercise position. This average distance is largely the distance from translator reference line 236, indicated by dot 236X in FIG. 20, to the fourth handle axes, generally indicated by dot 246X in FIG. 20.

User's feet 204 are once again placed respectively on foot pedals 224. User's hands 210 respectively grip frame handles 242 so that user's back 202 is generally directed upward. Because frame handles 242 are considerably further away from pedals 224 than are front seat handles 240, the user's body is curved upward somewhat rather than being in the severe crouch of FIG. 18.

User 200 exercises user's legs 206 in the crouched-to-prone exercise position of FIG. 20 by pumping foot pedals 224 with user's feet 204. User's arms 212 are simultaneously exercised due to the movement of the user's body and the accompanying weight placed on user's arms 212. User 200 can move frame handles 242 to maintain the user's balance and to further exercise user's arms 212. Exercising from the crouched-to-prone position of FIG. 19 exercises largely all of the user's major muscle groups, including the user's abdominal muscles. Once again, user 200 can look downward and backward to check readout display 222.

Instead of keeping user's hands 210 solely on frame handles 242, user's hands 212 can respectively switch to gripping back seat handles 108 or front seat handles 240 so that user 200 is generally in the crouched exercise position of FIG. 18. User 200 can thereby switch back and forth between the crouched-to-prone exercise position of FIG. 20 and the crouched exercise position of FIG. 18. With seatback 104U in the flat position, user's hands 210 may also be able to respectively switch to gripping upper seatback handles 110 so that user 200 is a prone exercise position analogous to that of FIG. 19. As a result, user 200 may be able to variously switch between crouched, crouched-to-prone, and prone exercise positions.

Figure 21:
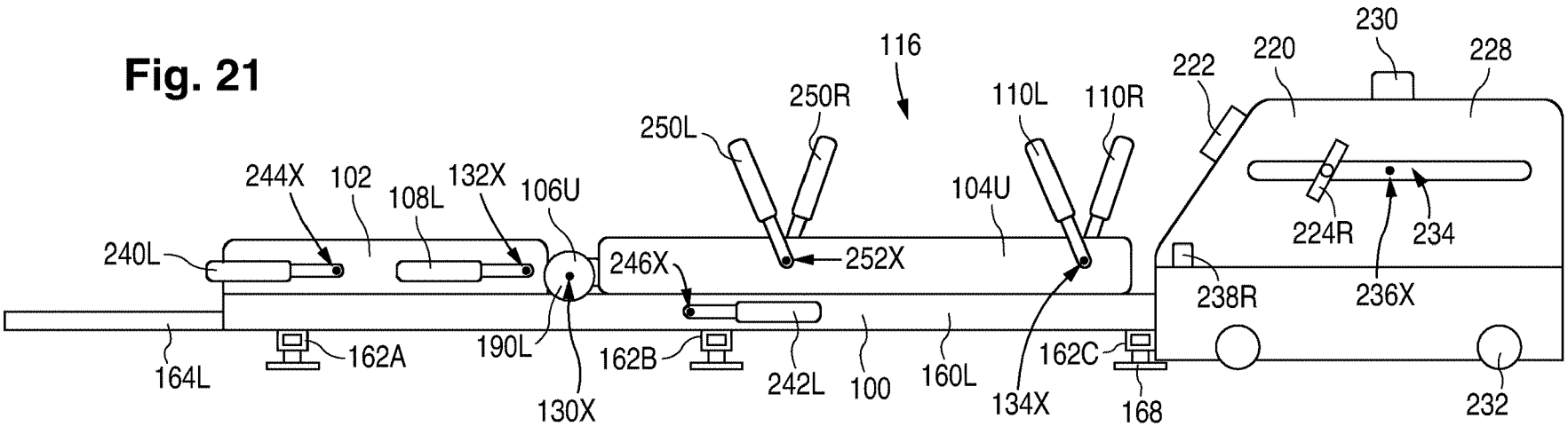
FIG. 21 is a side view of a variation, configured according to the invention, of the multi-function exercise machine of FIG. 17 as implemented with the alternative embodiment of the seatback and seatback-to-frame/seat connection mechanism of FIGS. 15*a* and 15*b*.

FIG. 21 illustrates a multi-function exercise machine configured in accordance with the invention for exercising various muscles of a user, including the user's legs and arms, in a crouched or crouched-to-prone exercise position. As a variation of the exercise machine of FIG. 17, the exercise machine of FIG. 21 consists of frame 100, seat 102, seatback 104U, seatback-to-frame/seat connection mechanism 106U, back seat handles 108, seatback handles 110, front seat handles 240, frame handles 242, an optional fifth pair of handles 250L and 250R (collectively "handles 250"), pedal-translating pedaling mechanism 220, and readout display 222. Frame 100, seat 102, seatback 104U, connection mechanism 106U, and handles 108, 110, 240, and 242 in main assembly 116 of the machine of FIG. 21 are respectively configured, interconnected, and operable the same as in the machine of FIG. 17 subject to (a) substitution of seatback 104U and connection mechanism 106U respectively for seatback 104 and connection mechanism 106, (b) modification of main assembly 116 to receive fifth handles 250, and (c) modification of frame 100 as described below in connection with FIG. 22. Seatback 104U and connection mechanism 106U in the machine of FIG. 21 can be respectively replaced with components 104 and 106.

FIG. 21 shows fifth handles 250, referred to here generally as "seatback" handles, as being received by seatback 104U at generally opposite locations along the side edges of seatback 104U closer to its bottom edge than to its top edge. Lower seatback handles 250 are preferably movable relative to seatback 104U. Depending on the configuration of seatback-to-frame/seat connection mechanism 106U, seatback handles 250 can alternatively be received by connection mechanism 106U at corresponding generally opposite locations close to the reception locations shown in FIG. 21. In that case, seatback handles 250 are preferably movable relative to connection mechanism 106U.

Analogous to what was said above about upper seatback handles 110, lower seatback handles 250 can move in various ways. Seatback handles 250 can be respectively turned about a pair of fifth handle axes whose location is generally indicated by dot 252X in FIG. 21. The fifth handle axes can be a common fifth handle axis extending generally parallel to the width of the exercise machine. Handles 250 can be rigidly connected together inside or behind seatback 104U. Handles 250 then turn simultaneously (in synchronism) about the common fifth handle axis. Alternatively, handles 250 can be respectively turned about the fifth handle axes independently of each other as generally indicated in the example of FIG. 21. The fifth handle axes can then be inclined or/and slightly laterally offset from each other.

Figure 22:
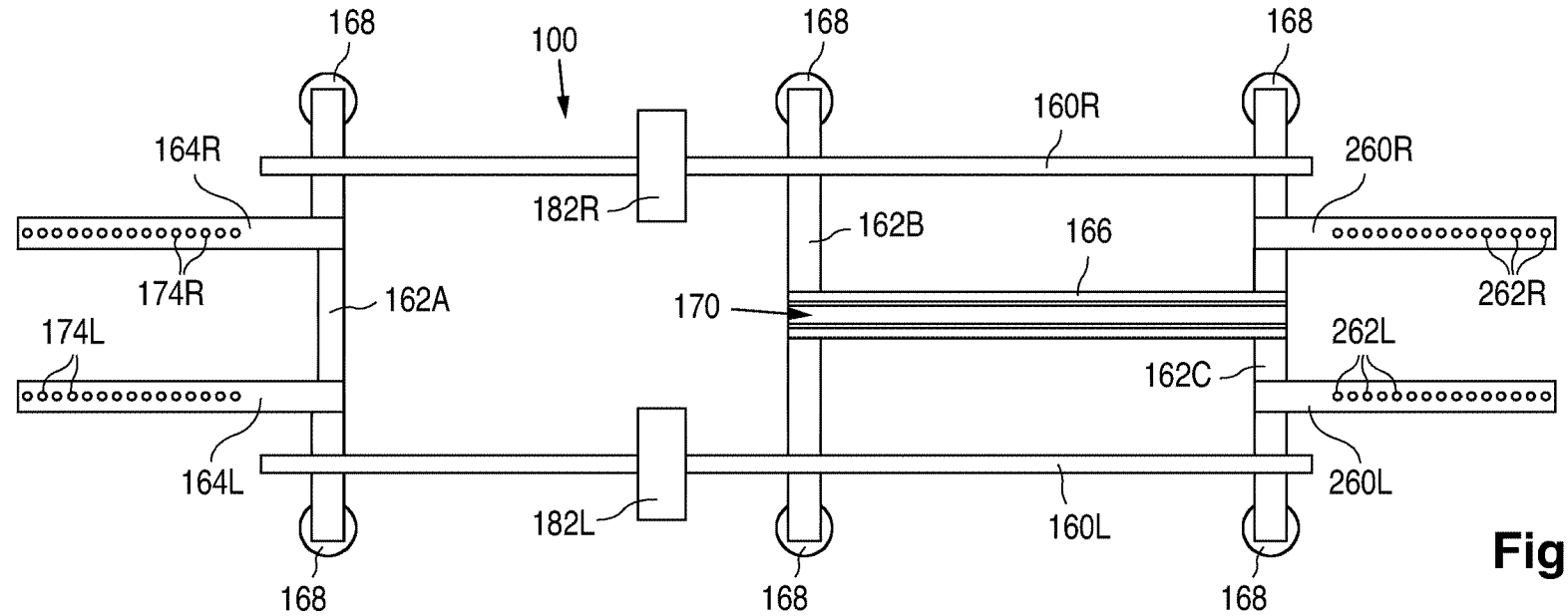
FIG. 22 is a top plan view of the frame in the exercise machine of FIG. 21 or FIG. 23.

Referring to FIG. 22, frame 100 in the exercise machine of FIG. 21 is an assembly consisting of long rails 160, cross rails 162, short rails 164, channel portion 166, frame feet 168, and a further pair of short longitudinal rails 260L and 260R (collectively "short rails 260") extending generally parallel to long rails 160. Long rails 160, cross rails 162, short rails 164, channel portion 166, and frame feet 168 in frame 100 of the machine of FIG. 21 are respectively configured and interconnected the same as in the exercise machine of FIG. 17.

Further short rails 260 are situated on, and rigidly connected to, back cross rail 162C in the exercise machine of FIG. 21 at locations between long rails 160 and extend backward beyond long rails 160. In particular, short rails 260 typically extend backward beyond long rails 160 approximately the same distance that short rails 164 extend forward beyond long rails 160. Short rails 260 typically consist of metal and are typically hollow but can be solid. As discussed below in connection with FIGS. 28, 29*a*, and 29*b*, short rails 260 can be flexibly connected to cross rail 162C so that they can be placed in a position in which they do not extend backward beyond long rails 160 when they are not connected to pedaling mechanism 220 or another such exercise mechanism.

Returning to FIG. 21, pedaling mechanism 220 is adjustably connected to the back end of frame 100 of main assembly 116 in largely the same manner that pedaling mechanism 220 is adjustably connected to the front end of frame 100 of assembly 116 in the exercise machine of FIG. 17. In particular, short rails 260 respectively extend into the above-mentioned pair of openings (again not shown) in the back of pedaling mechanism 220. A plurality of vertical circular openings 262L situated generally in a line extend through short rail 260L. A like plurality of vertical circular openings 262R situated generally in a line extend through short rail 260R. Openings 262R are respectively situated substantially directly opposite openings 262L. Openings 262L and 262R (collectively "openings 262") are thereby allocated into pairs of oppositely situated openings 262.

Distance-adjustment knob 238R (see FIGS. 11-13 and 21) is situated generally above the line of openings 262R in short rail 260L while distance-adjustment knob 238L (likewise see FIGS. 11-13 and 21) is situated generally above the line of openings 262L in short rail 260R. The internal extensions (not shown) of knobs 238 respectively pass through a selected one of the pairs of oppositely situated openings 262 thereby connecting pedaling mechanism 220 to the back end of frame 100. The knob extensions also respectively pass through a pair of openings in an underlying piece of material rigidly connected to translator housing 228 to make the connection solid.

To adjust the connection of pedaling mechanism 220 to the back end of main assembly 116, distance-adjustment knobs 238 are first pulled sufficiently upward to release the connection. The depth to which short rails 260 extend into the openings in pedaling mechanism 220 is appropriately changed. Knobs 238 are then pushed downward so that the knob extensions pass through another selected pair of oppositely situated openings 262 and through the two openings in the underlying piece of material connected to housing 228. In addition to being adjustably connected to main assembly 116, pedal-translating mechanism 220 can be readily disconnected from assembly 116 to facilitate exercise machine storage and to enable another exercise mechanism, such as pedal-revolving mechanism 112 or that described below in connection with FIG. 24, to be adjustably connected to the back end of assembly 116.

Seatback 104 is normally in the flat position when a user actuates pedals 224 in exercising with the multi-function exercise machine of FIG. 21. In light of the explanation below of how a user utilizes the exercise machine of FIG. 21 to exercise in a crouched position, the average distance from foot pedals 224 to upper seatback handles 110 can be adjusted to accommodate the user's size for exercising in the crouched position. This distance is largely the distance from translator reference line 236, indicated by dot 236X in FIG. 21, to second handle axes 134L and 134R (see FIG. 5), indicated by dot 134X in FIG. 21.

FIG. 21 depicts the situation in which pedaling mechanism 220 touches or nearly touches the back ends of long rails 160 of frame 100 and thus the situation in which the average distance from foot pedals 224 to upper seatback handles 110 is at a minimum value. Alternatively or additionally, pedaling mechanism 220 can touch or nearly touch the top edge of seatback 104U when the average distance from foot pedals 224 to seatback handles 110 is at the minimum value. Pedaling mechanism 220 is spaced apart from the back ends of long rails 160 or/and the top edge of seatback 104U when the average distance from foot pedals 224 to seatback handles 110 is adjusted to exceed the minimum value.

A user utilizes the exercise machine of FIG. 21 to exercise in a crouched position similar to that of user 200 in FIG. 18 except that the user's body relative to main assembly 116 in FIG. 21 is generally oriented in the opposite direction to that of the user's body relative to assembly 116 in FIG. 18. More particularly, the user's hands respectively grip upper seatback handles 110. The user's feet are placed respectively on foot pedals 224 so that the user is crouched with the user's back generally directed upward. The average distance from pedals 224 to seatback handles 110 is chosen so that the user is in a severe crouch when the user is an average-size adult.

The user pumps foot pedals 224 respectively with the user's feet to exercise the user's legs and arms as described above in connection with FIG. 18. The user can move upper seatback handles 110 to maintain the user's balance and to further exercise the user's arms. Instead of gripping upper seatback handles 110, the user's hands can grip lower seatback handles 250 or frame handles 242 while in the crouched position. The user's hands can also variously grip, e.g. switch back and forth between, upper seatback handles 110 and lower seatback handles 250 or frame handles 242. The user can look downward and backward to check readout display 222 for exercise information.

Similar opposite-orientation comments apply to use of the exercise machine of FIG. 21 for exercising in a crouched-to-prone position. In particular, a user utilizes the exercise machine of FIG. 21 to exercise in the crouched-to-prone position similar to that for user 200 in FIG. 20 except that the user's body relative to main assembly 116 is generally oriented in the opposite direction to that of the user's body relative to assembly 116 in FIG. 20. The user's hands respectively grip back seat handles 108 or front seat handles 240. The user's feet are placed respectively on foot pedals 224 so that the user's back is generally directed upward.

For exercising in the crouched-to-prone position with the exercise machine of FIG. 21, the average distance from pedals 224 to back seat handles 108 or front seat handles 240 is chosen so that the user's body is curved somewhat upward similar to what is illustrated in FIG. 20 for user 200. The average distance from pedals 224 to back seat handles 108 is largely the distance from translator reference line 236 (dot 236X in FIG. 21) to first handle axes 132L and 132R (see FIG. 5), indicated by dot 132X in FIG. 21. Similarly, the average distance from pedals 224 to front seat handles 240 distance is largely the distance from translator reference line 236 (again dot 236X in FIG. 21) to the third handle axes indicated by dot 244X in FIG. 21.

Foot pedals 224 are pumped with the user's feet to exercise the user's legs and arms as described above in connection with FIG. 20. Depending on whether the user's hands are gripping back seat handles 108 or front seat handles 240, the user can move seat handles 108 or 240 to maintain the user's balance and to further exercise the user's arms. While in the crouched-to-prone exercise position, the user's hands can switch to gripping lower seatback handles 250 or frame handles 242. In fact, the user can switch back and forth between the crouched-to-prone and crouched exercise positions. The user can again look downward and backward to check readout display 222.

Figure 23:
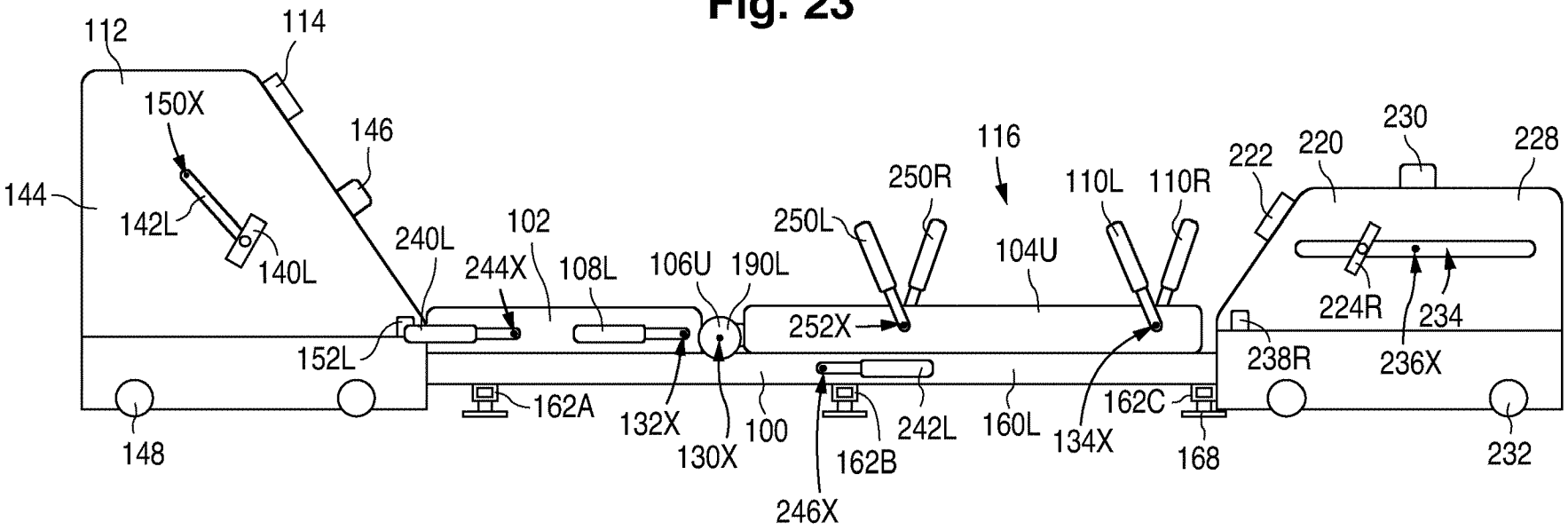
FIG. 23 is a side view of an extension, configured according to the invention, of the multi-function exercise machines of FIGS. 3-5 and FIG. 21.

FIG. 23 illustrates a multi-function exercise machine configured in accordance with the invention for variously exercising various muscles, including the legs, arms, and abdominal muscles, of a user using any of a number of different exercise positions. As an extension of the exercise machines of FIGS. 3-5 and FIG. 21, the machine of FIG. 23 is formed with main assembly 116, pedal-revolving mechanism 112, pedal-translating mechanism 220, and readout displays 114 and 222 where main assembly 116 here includes seatback 104U and seatback-to-frame/seat connection mechanism 106U rather than components 104 and 106. Frame 100, seat 102, seatback 104U, connection mechanism 106U, and handles 108,110, 240, 242, and 250 in main assembly 116 of the machine of FIG. 23 are respectively configured, interconnected, and operable as described above for the exercise machine of FIG. 21.

Pedal-translating mechanism 220 in the exercise machine of FIG. 23 is adjustably connected to the back end of frame 100 as described above for the exercise machine of FIG. 21. Pedal-revolving mechanism 112 in the machine of FIG. 23 is adjustably connected to the front end of frame 100 as described above for the exercise machine of FIGS. 3-5. Both of pedaling mechanisms 112 and 220 can be disconnected from frame 100 to facilitate exercise machine storage.

FIG. 23 depicts the situation in which seatback 104U is in the flat position. A user can then utilize the multi-function exercise machine of FIG. 23 to exercise in the crouched and crouched-to-prone positions with pedal-translating mechanism 220 as described above in connection with the exercise machine of FIG. 21 and thus similar to what is shown in FIGS. 18 and 20. With seatback 104U in the inclined position, the user can utilize the machine of FIG. 23 to exercise in the seated position with pedal-revolving mechanism 112 as generally shown in FIG. 10 except that seatback 104U and connection mechanism 106U replace components 104 and 106.

Pedal-revolving mechanism 112 can be disconnected from main assembly 116 in the exercise machine of FIG. 23 to produce the exercise machine of FIG. 21 for which a user can exercise in the crouched and crouched-to-prone positions using pedal-translating mechanism 220. On the other hand, pedal-translating mechanism 220 can be disconnected from main assembly 116 in the machine of FIG. 23 to produce a variation of the exercise machine of FIGS. 3-5 in which frame 100 includes short rails 260 and in which components 104U and 106U replace components 104 and 106. The user can then exercise in the seated position using pedal-revolving mechanism 112 as generally shown in FIG. 10.

Pedal-translating mechanism 220 can be disconnected from the back end of main assembly 116 in the exercise machine of FIG. 23 and, after disconnecting pedal-revolving mechanism 112 from assembly 116, can be connected to the front end of assembly 116 to produce a variation of the exercise machine of FIGS. 11 and 12 in which frame 100 again includes short rails 260 and in which components 104U and 106U again replace components 104 and 106. A user can utilize the resulting exercise machine to exercise in the seated position with pedal-translating mechanism 220 as described above in connection with FIG. 14.

Disconnection of pedal-revolving mechanism 112 from the front end of main assembly 116 and transference of pedal-translating mechanism 220 from the back end of assembly 116 to the front end of assembly 116 produces a variation of the exercise machine of FIG. 17 in which frame 100 once again includes further short rails 260 and in which components 104U and 106U once again replace components 104 and 106. In addition to exercising in the seated position with pedal-translating mechanism 220 as described above in connection with FIG. 14, a user can exercise in the crouched, crouched-to-prone, and largely prone positions with pedal-translating mechanism 220 as described above in connection with FIGS. 18-20. If desired, pedal-revolving mechanism 112 can be connected to the back end of main assembly 116 via short rails 260.

In short, pedaling mechanisms 112 and 220 in the machine of FIG. 23 can be connected to main assembly 116 in various ways. This enables a user to exercise variously in the crouched, crouched-to-prone, and largely prone positions with pedal-translating mechanism 220 and in the seated position with pedal-revolving mechanism 112 or pedal-translating mechanism 220.

Exercise Machine with Handle-Translating Mechanism

Figure 24:
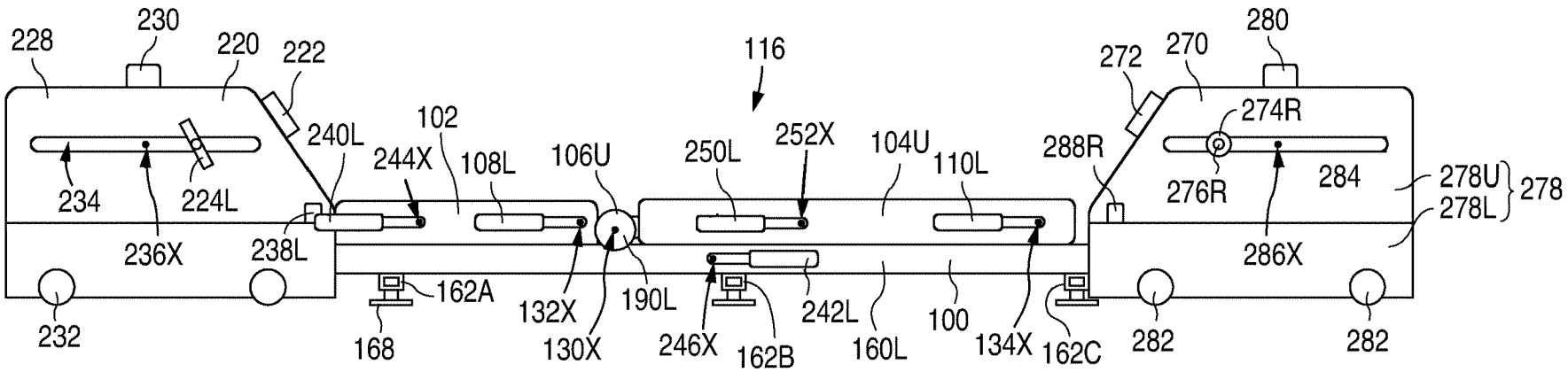
FIG. 24 is a side view of another multi-function exercise machine configured according to the invention for exercising various muscles, including the legs, arms, and abdominal muscles, of a user.

FIG. 24 illustrates a multi-function exercise machine configured in accordance with the invention for enabling a user to exercise various muscles, including the user's legs, arms, and abdominal muscles. The exercise machine of FIG. 24 is formed with main assembly 116, pedal-translating mechanism 220, a handle-translating mechanism 270, readout display 222, and another visual readout display 272 where main assembly 116 here includes seatback 104U and seatback-to-frame/seat connection mechanism 106U rather than components 104 and 106. Frame 100, seat 102, seatback 104U, connection mechanism 106U, and handles 108, 110, 240, 242, and 250 in main assembly 116 of the machine of FIG. 24 are configured, interconnected, and operable as described above for the exercise machine of FIG. 21. Readout display 272 provides largely the same exercise information as readout display 222 and thus largely the same exercise information as readout display 114.

Pedaling mechanism 220, with on-board readout display 222, is adjustably connected to the front end of frame 100 of main assembly 116 in the same way that pedaling mechanism 220 is adjustably connected to the front end of frame 100 in the exercise machine of FIG. 17. Similarly, handle-translating mechanism 270 is adjustably connected to the back end of frame 100 of main assembly 116 in the same way that pedaling mechanism 220 is adjustably connected to the back end of frame 100 in the exercise machine of FIG. 21.

Figure 25:
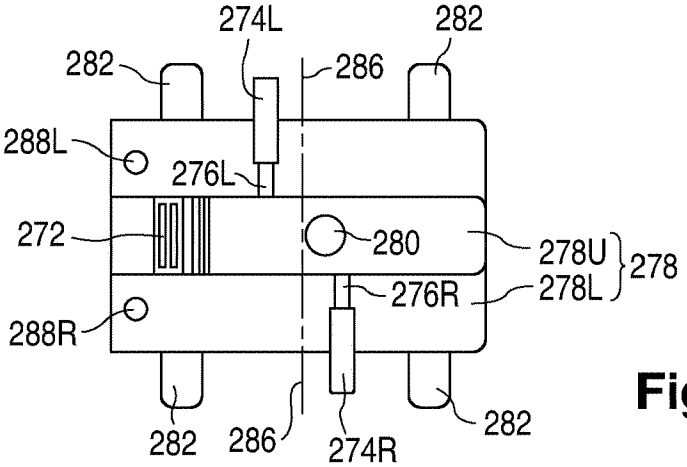
FIG. 25 is a top view of the handle-translating mechanism in the exercise machine of FIG. 24.

Handle-translating mechanism 270, further illustrated in FIG. 25, consists of a pair of translatable handles 274L and 274R (collectively "handles 274"), a pair of handle connectors 276L and 276R (collectively "connectors 276"), a translator housing 278, an internal translating apparatus (not shown) situated inside translator housing 278, a resistance-adjustment knob 280 for adjusting the handle-translating resistance, and a group of housing feet 282. Handle connectors 276, translator housing 278, resistance-adjustment knob 280, and housing feet 282, are configured, interconnected, and operable the respectively the same as pedal connectors 226, translator housing 228, resistance-adjustment knob 230, and housing feet 232 in pedal-translating mechanism 220. The same applies to the internal translating apparatus inside translator housing 278.

Translator housing 278 consists of an upper portion 278U and a wider lower portion 278L that provides pedal-translating mechanism 270 with mechanical stability. Readout display 272 is situated on the slanted back surface of upper housing portion 278U. Resistance-adjustment knob 280 is illustrated in FIG. 24 as being situated on top of housing 278 but can be located elsewhere on housing 278. Handle connectors 276 are connected to the internal translating apparatus of handle-translating mechanism 270 through two respective generally straight opposing connector slots 284 in the sides of upper housing portion 278U. Connector slots 284 are configured the same as connector slots 234 in pedal-translating mechanism 220.

Translatable handles 274L and 274R are respectively connected to handle connectors 276L and 276R so as to allow each handle 274L or 274R to rotate around a portion of that handle's connector 276L or 276R. Because the internal translating apparatus inside translator housing 278 is configured and operable the same as the internal translating apparatus inside translator housing 228 of pedal-translating mechanism 220, handle connectors 276 translate back and forth in connector slots 284 in the same way that pedal connectors 226 translate back and forth in connector slots 234 of pedal-translating mechanism 220. Handles 274 thus translate back and forth in the direction of connector slots 284 in the same way that foot pedals 224 translate back and forth in the direction of connector slots 234. In fact, pedal-translating mechanism 220 can be converted into handle-translating mechanism 270 by substituting handles 274 respectively for pedals 224. Each cycle of the instantaneous cycling rate presented on readout display 272 consists of a full back and forth translation of one of handles 274.

Item 286 in FIG. 25 is a translator reference line that generally represents the neutral location for translatable handles 274 when they are directly opposite each other. Translator reference line 286 for the handle-opposing position extends parallel to the width of the exercise machine and normally lies in the plane through which the common center of mass of handles 274 translates back and forth. In FIG. 24, dot 286X indicates the location of reference line 286. The longitudinal distance from handles 274, i.e., reference line 286, to another exercising part of the exercise machine of FIG. 24 is adjusted with a pair of knobs 288L and 288R (collectively "knobs 288") situated on lower housing portion 288L on opposite sides of upper housing portion 288U typically close to the back of handle-translating mechanism 270. Distance-adjustment knobs 288 have internal extensions and function the same as distance-adjustment knobs 238 on pedal-translating mechanism 220.

With pedal-translating mechanism 220 connected to the front end of main assembly 116 in the multi-function exercise machine of FIG. 24, a user can utilize pedaling mechanism 220 to exercise with the machine of FIG. 24 in any of the ways described above for exercising with the exercise machines of FIGS. 11 and 12 and FIG. 17 in which pedaling mechanism 220 is similarly connected to the front end of assembly 116. For instance, the user can exercise with the machine of FIG. 24 using the seated, crouched, largely prone but somewhat slanted, and crouched-to-prone exercise positions of FIGS. 14 and 18-20.

Figure 26:
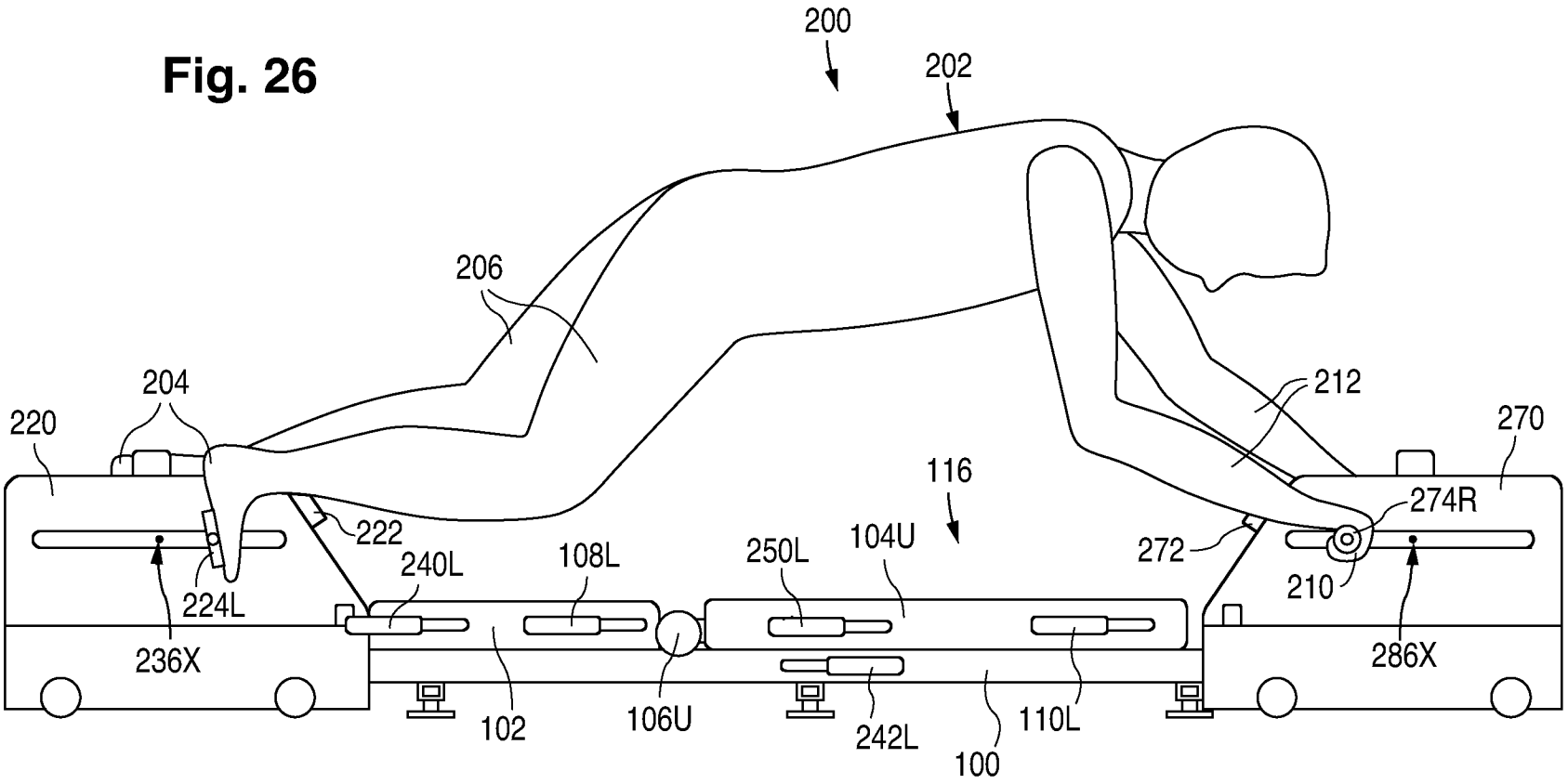
FIGS. 26 and 27 are side views of two respective examples of how the exercise machine of FIG. 24 is used according to the invention.

FIG. 26 presents an example of how user 200 utilizes the exercise machine of FIG. 24 to exercise in a nearly fully prone exercise position with pedal-translating mechanism 220 and handle-translating mechanism 270. As necessary, the connection of pedal-translating mechanism 220 or/and handle-translating mechanism 270 to frame 100 is adjusted so that the average distance from foot pedals 224 to translatable handles 274 is suitable for enabling user 200 to be in the indicated prone position. This average distance is largely the distance from translator reference line 236, indicated by dot 236X in FIG. 26, to translator reference line 286, generally indicated by dot 286X in FIG. 26.

User's hands 210 respectively grip translatable handles 274 for the exercise position of FIG. 26. User's feet 204 are placed respectively on foot pedals 224 so that user 200 is nearly fully prone, i.e., user's back 202 is directed nearly fully upward. In this exercise position, user 200 exercises user's legs 206 by pumping foot pedals 224 with user's feet 204 to cause pedals 224 to translate back and forth. User 200 exercises user's arms 212 by pressing laterally on handles 274 with user's hands 210 to cause handles 274 to translate back and forth. User's arms 212 can be so exercised at the same time as user's legs 206 or at different times. User 200 can look downward and backward to check readout display 222 for information on the exercise of user's legs 206. User 200 can also look generally downward to check readout display 272 for information on the exercise of user's arms 212.

Exercising using the prone position of FIG. 26 can be done with the locations of pedal-translating mechanism 220 and handle-translating mechanism 272 reversed. That is, handle-translating mechanism 270 can be connected to the front end of main assembly 116 while pedal-translating mechanism 220 is connected to the back end of assembly 116.

Figure 27:
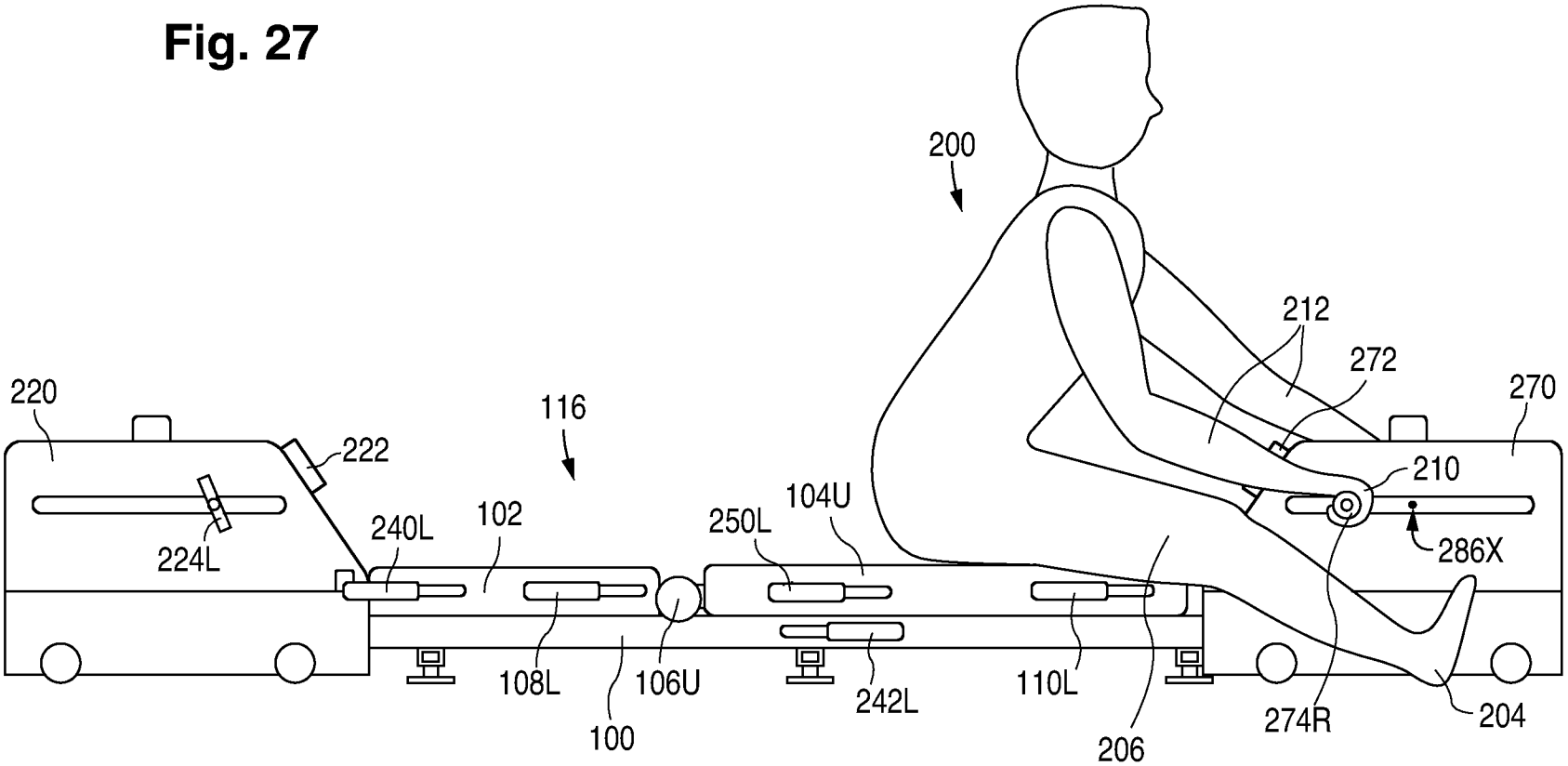

FIG. 27 presents an example of how user 200 utilizes the exercise machine of FIG. 24 to exercise user's arms 212 with seatback 104U in the flat position. In this example, user 200 is seated on the back of seatback 104U. User's hands 210 respectively grip translatable handles 274. User's legs 206 extend respectively to the sides of the exercise machine. User's feet 204 may touch the surface on which the exercise machine is situated. User's hands 210 press laterally on handles 274 to cause them to translate back and forth, thereby exercising user's arms 212. By looking generally downward, user 200 can check readout display 272 for exercise information.

As with the prone exercise position of FIG. 26, exercising using the seated position of FIG. 27 can be done with the locations of pedal-translating mechanism 220 and handle-translating mechanism 270 reversed. In that case, the user sits on seat 102. Seatback 104U can be in the flat or inclined position. The exercise position of FIG. 27 can also be done with pedal-translating mechanism 220 disconnected from main assembly 116. In the example shown in FIG. 27 and in these variations, main assembly 116 serves as a support structure for seatably receiving the user, i.e., on which the user sits.

Exercise Benches

Main assembly 116, variously including pairs of handles 108, 110, 240, 242, and 250, serves as an exercise bench in accordance with the invention regardless of whether pedal-revolving mechanism 112, pedal-translating mechanism 220, handle-translating mechanism 270, or a similar exercise mechanism is, or is not, connected to the front or back end of assembly 116. A user can utilize handles 108, 110, 240, 242, and 250 variously provided on exercise bench 116 to do various exercises without actuating mechanism 112, 220, or 270 or a similar exercise mechanism. The user can also do exercises on bench 116 without employing any of handles 108, 110, 240, 242, and 250.

Figure 28:
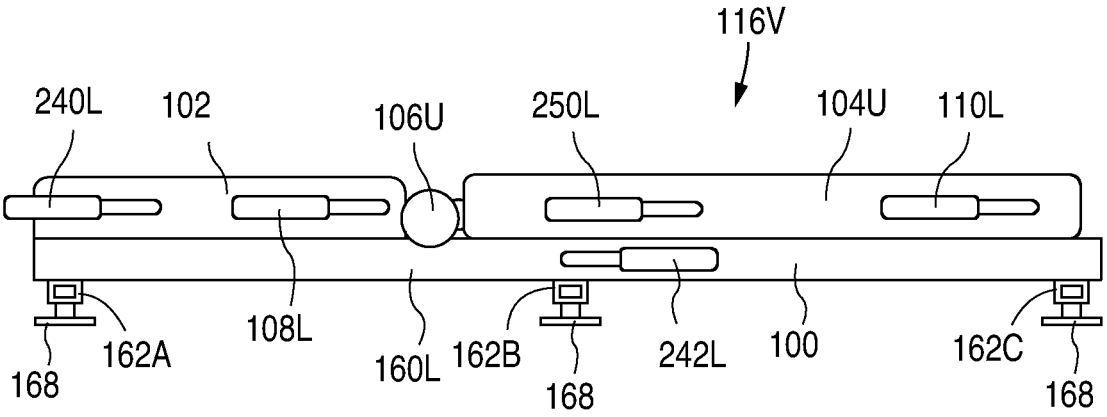
FIG. 28 is a side view of a multi-function exercise bench configured according to the invention as a variation of the main assembly in the exercise machine of FIG. 21, FIG. 23, or FIG. 24.

FIG. 28 illustrates a variation 116V of main assembly 116 configured in accordance with the invention. Main assembly 116V can be substituted for main assembly 116 in any of the exercise machines of the invention. In addition, main assembly 116V is particularly suitable for use as an exercise bench.

Main assembly 116V consists of frame 100, seat 102, seatback 104U, connection mechanism 106U, and handles 108, 110, 240, 242, and 250 respectively configured, interconnected, and operable as described above except for the connections of short rails 164 and 260 respectively to cross rails 162A and 162C in frame 100. Short rails 164 at the front end of frame 100 are flexibly connected to front cross rail 162A for enabling short rails 164 to be placed in a retracted (or non-use) position in which they do not extend forward beyond long rails 160. Short rails 260 at the back end of frame 100 are likewise flexibly connected to back cross rail 162C for enabling short rails 260 to be placed in a retracted (or non-use) position in which they do not extend backward beyond long rails 160. Placement of short rails 164 and 260 in their retracted positions facilitates use of main assembly 116V as an exercise bench.

FIG. 28 depicts the situation in which flexibly connected short rails 164 and 260 are in their retracted positions. Because short rails 164 and 260 are thereby hidden by long rails 160 when main assembly 116V is viewed from the side, short rails 164 and 260 do not appear in the side view of FIG. 28. Short rails 164 are in an extended (or use) position when they extend fully forward beyond the front ends of long rails 160. Short rails 260 are similarly in an extended (or use) position when they extend fully backward beyond the back ends of long rails 160. When short rails 164 and 260 are in their extended positions, frame 100 of main assembly 116V appears substantially as shown in FIG. 22 except for the elements that flexibly connect short rails 164 and 260 respectively to cross rails 162A and 162C.

The flexible connection of short rails 164 to front cross rail 162A can be implemented by slidably connecting short rails 164 to front cross rail 162A so that they can slide in sliding members rigidly connected to cross rail 162A. The flexible connection of short rails 260 to back cross rail 162C can likewise be implemented by slidably connecting short rails 260 to cross rail 162C so that they can slide in sliding members rigidly connected to cross rail 162C. Pushing short rails 164 and 260 so that they slide to locations fully between long rails 160 places short rails 164 and 260 in their retracted positions. In their retracted positions as viewed from above (or below) frame 100, most of each of short rails 164 lies between front cross rail 162A and middle cross rail 162B while most of each of short rails 260 lies between back cross rail 162C and middle cross rail 162B.

The flexible connection of short rails 260 to back cross rail 162C can alternatively be implemented by hingably connecting short rails 260 to cross rail 162C. When seatback 104U is turned sufficiently upward, short rails 260 can be rotated upward around respective hinges attached to back cross rail 162C and then downward so that they end up in a retracted position largely between cross rails 162C and 162B as viewed from above frame 100. If seat 102 can be readily removed from frame 100, the flexible connection of short rails 164 to front cross rail 162A can likewise alternatively be implemented by hingably connecting short rails 164 to cross rail 162A. Short rails 164 can then be rotated upward around respective hinges attached to front cross rail 162A and downward so that they similarly end up in a retracted position largely between cross rails 162A and 162B as viewed from above frame 100.

Regardless of how short rails 164 and 260 are respectively flexibly connected to cross rails 162A and 162C, locking members hold short rails 164 and 260 in place when they are in their extended and retracted positions. When short rails 164 or 260 are locked in their extended positions, main assembly 116V is suitable for receiving pedal-revolving mechanism 112, pedal-translating mechanism 220, handle-translating mechanism 270, or another exercise mechanism at the front or back end of frame 100 to produce variations of the present exercise machines.

Figure 29A:
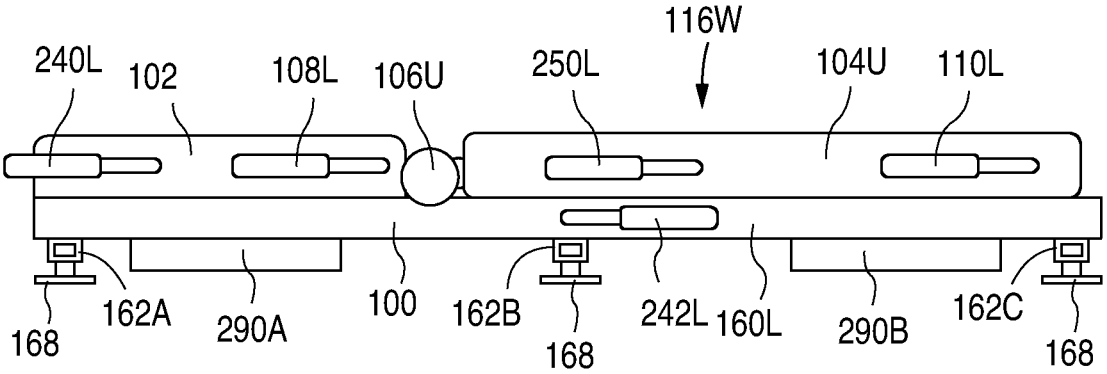
FIGS. 29*a* and 29*b* are side views of another multi-function exercise bench configured according to the invention as a variation of the main assembly in the exercise machine of FIG. 21, FIG. 23, or FIG. 24.
Figure 29B:
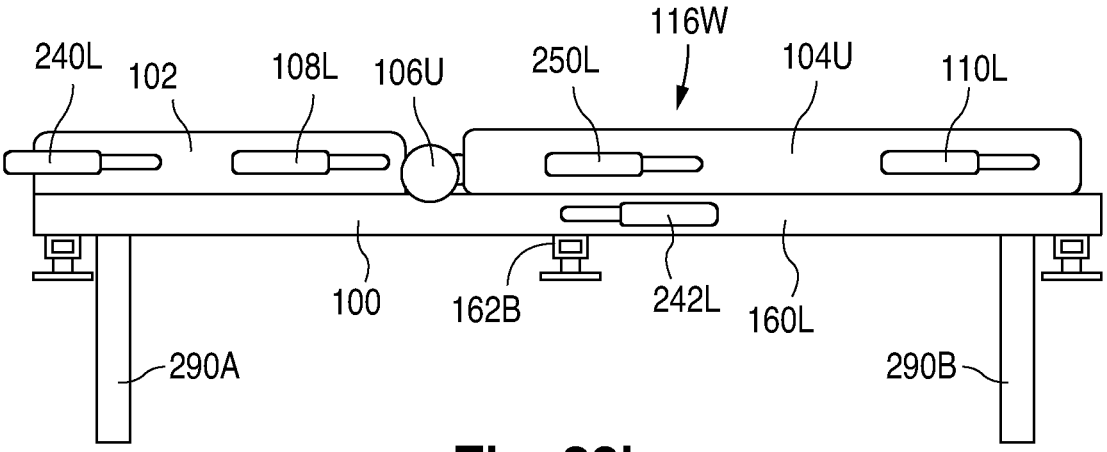

FIGS. 29*a* and 29*b* (collectively "FIG. 29") illustrate another variation 116W of main assembly 116 configured in accordance with the invention. As with main assembly 116V, main assembly 116W can be substituted for main assembly 116 in any of the present exercise machines. Additionally, main assembly 116W is especially suitable for use as an exercise bench whose upper surface is in the vicinity of 30-50 cm above the surface on which assembly 116W is situated.

Main assembly 116W consists of frame 100, seat 102, seatback 104U, connection mechanism 106U, and handles 108, 110, 240, 242, and 250 respectively configured, interconnected, and operable as in main assembly 116V subject to connection of frame 100 to a set of retractable frame legs that enable the top of seat 102 to be roughly 30-50 cm above the underlying surface when the legs are in their extended (or use) positions. FIG. 29 illustrates two such retractable frame legs 290A and 290B (collectively "legs 290"). Each of frame legs 290 is shaped generally like a "U" with a generally straight cross member connecting the two side members of the "U". The two side members of leg 290A are respectively flexibly connected, typically by hinges (not shown), to the bottoms of long rails 160 near front cross rail 162A. The two side members of leg 290B are respectively flexibly connected, likewise typically by hinges (also not shown), to the bottoms of long rails 160 near back cross rail 162C.

FIG. 29*a* depicts how main assembly 116W appears when frame legs 290 are in their retracted (or non-use) positions so that the two side members of each of legs 290 respectively lie against, or nearly against, long rails 160. Frame feet 168 extend further downward than legs 290 when they are in their retracted positions. Legs 290 are switched to their extended positions by rotating them approximately 90° downward away from middle cross rail 162B. FIG. 29*b* depicts how assembly 116W appears when legs 290 are in their extended positions so that the two side members of each of legs 290 extend downward approximately perpendicular to long rails 160. The bottoms of the cross members of legs 290 may be configured to inhibit legs 290 from slipping on the underlying surface. Locking members (not shown) hold legs 290 in place when they are in their retracted and extended positions.

When main assembly 116V or 116W serves as an exercise bench, a user can utilize exercise bench 116V or 116W in performing various exercises. More particularly, the user can utilize handles 108, 110, 240, 242, and 250 to do various exercises in which user's hands respectively grip handles 108, 110, 240, 242, or 250. Seatback 104U can be in the inclined or flat position. When seatback 104U is in the inclined position, the user can be seated on bench 116V or 116W with the user's back lying against seatback 104U so that the user's abdominal muscles are exercised by swiveling seatback 104U about swivel axis 122. One or more of the pairs of handles 108, 110, 240, 242, and 250 may also be readily removed from bench 116V or 116W to facilitate doing exercises which do not involve those particular handles 108, 110, 240, 242, or/and 250.

Figure 30A:
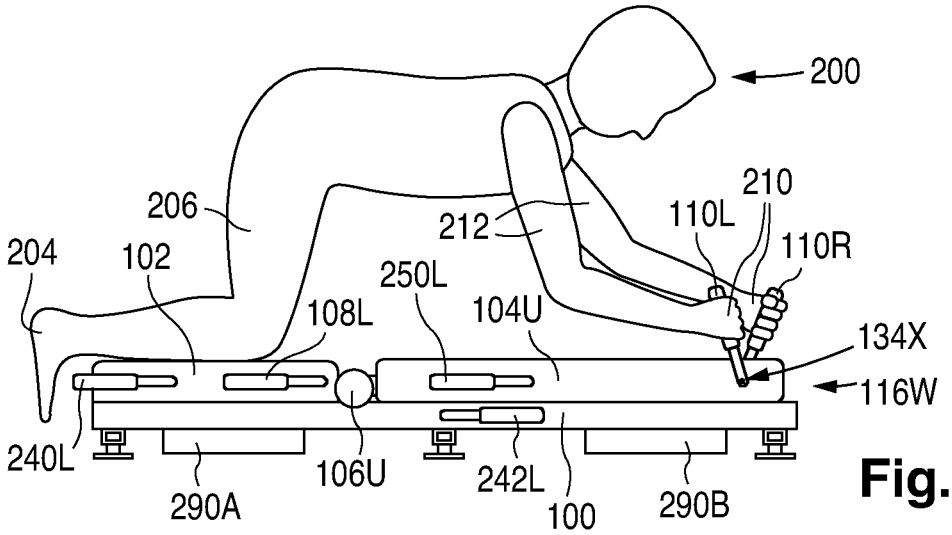
FIGS. 30*a*, 30*b*, and 30*c* are side views of three respective examples of how the exercise bench of FIGS. 29*a* and 29*b* is used according to the invention for exercising with the bench's handles.
Figure 30B:
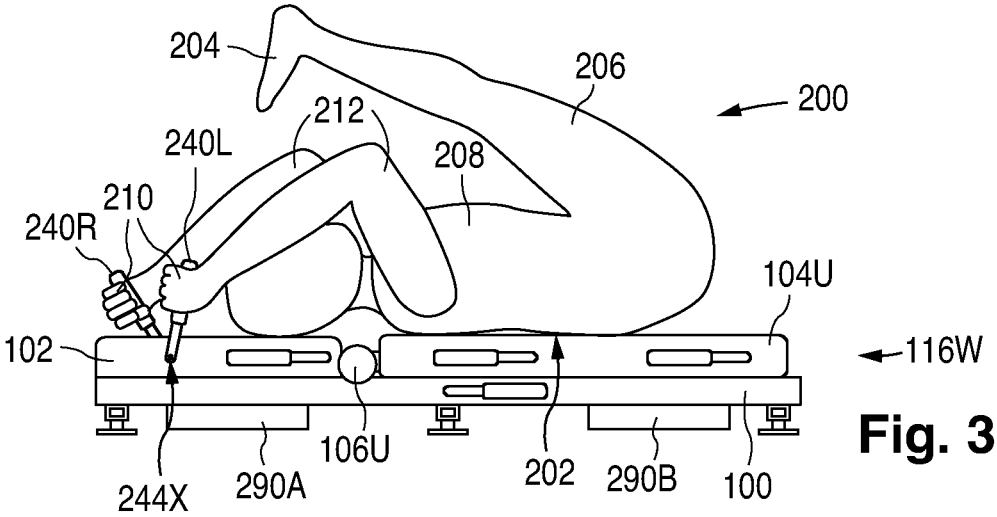
Figure 30C:
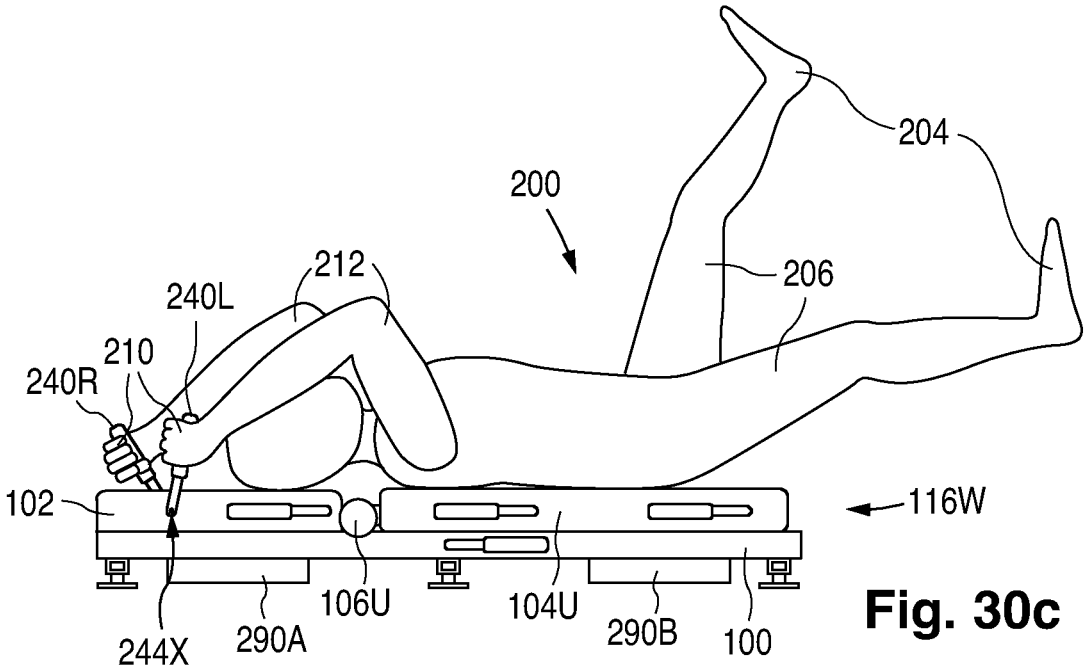

FIGS. 30*a*-30*c* illustrate three examples of exercises performed with exercise bench 116W while seatback 104U is in the flat position and short rails 164 and 260 and legs 290 are in their respective retracted positions. In the exercise of FIG. 30*a*, user 200 is in a crawl position with the lower parts of user's legs 206 on top of bench 116W. User 200 moves upper seatback handles 110 with user's hands 210 to exercise user's arms 212. The exercise of FIG. 30*b* involves moving front seat handles 240 while user's back 202 is top of bench 116W with user's legs 206 above user's torso 208. The exercise of FIG. 30*c* is the same as that of FIG. 30*b* except that user's legs 206 move back and forth. The exercises of FIGS. 30*b* and 30*c* exercise user's arms 212, user's legs 206, and the user's abdominal muscles. User 200 can perform the exercises of FIGS. 30*a*-30*c*, or exercises similar to those of FIGS. 30*a*-30*c*, by gripping others of handles 108, 110, 240, 242, and 250 than those gripped in FIGS. 30*a*-30*c* and/or with the user's body oriented opposite to what is shown in FIGS. 30*a*-30*c*.

Figure 31A:
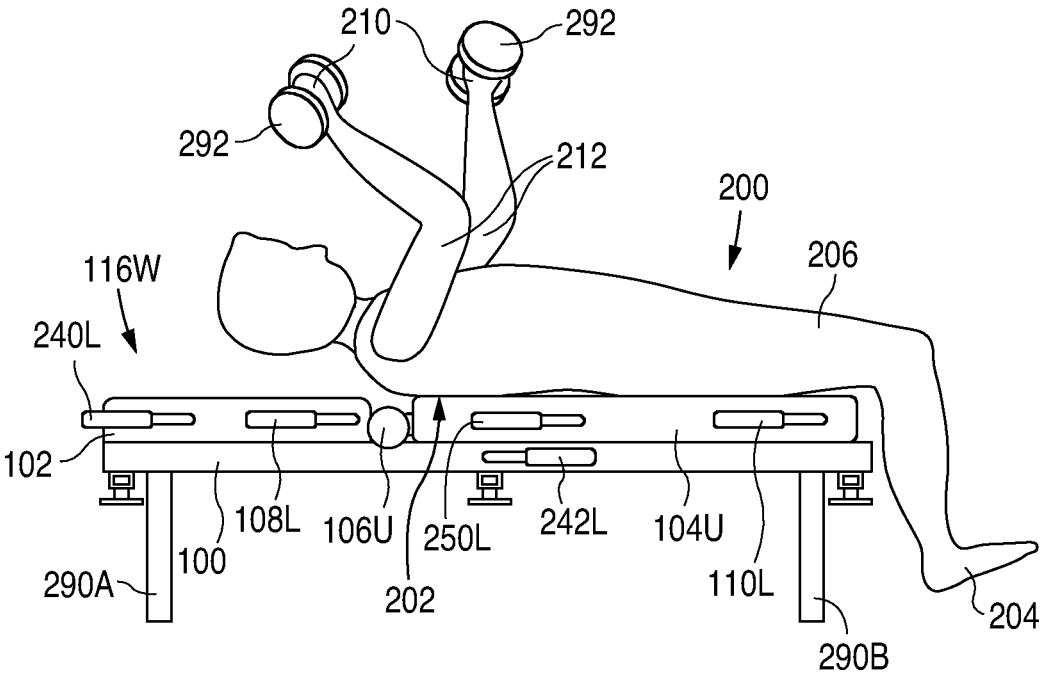
FIGS. 31*a* and 31*b* are side views of two respective examples of how the exercise bench of FIGS. 29*a* and 29*b* is used according to the invention for exercising with free weights.
Figure 31B:
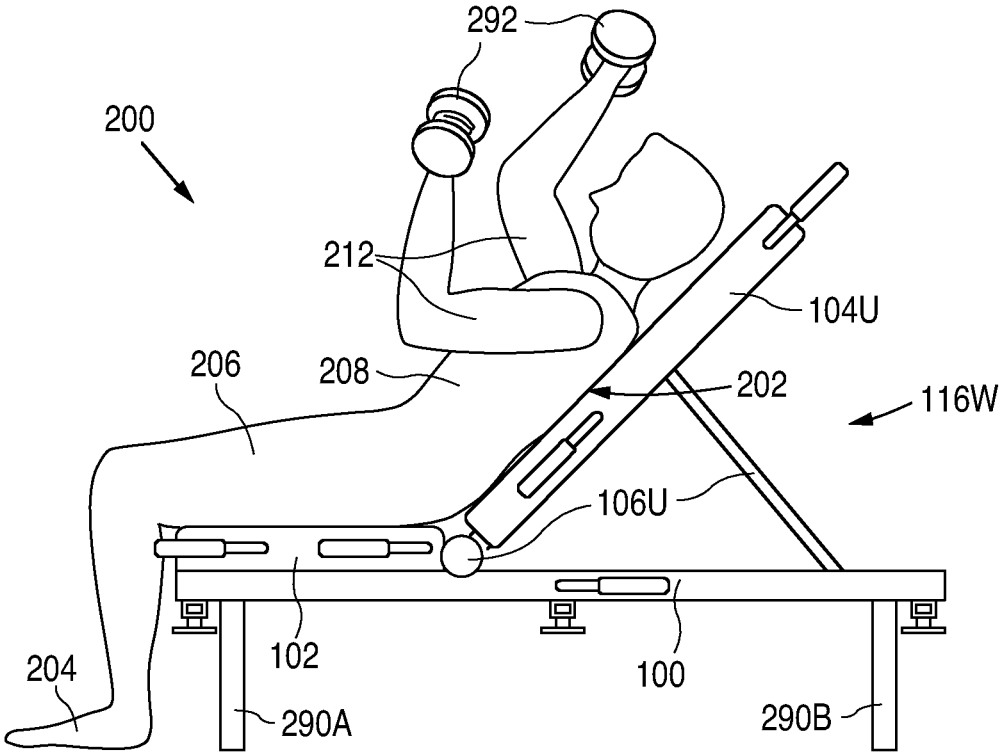

A user can also utilize exercise bench 116V or 116W to do exercises that do not involve moving any of handles 108, 110, 240, 242, and 250. FIGS. 31*a* and 31*b* examples of such exercises performed with exercise bench 116W while short rails 164 and 260 are in their retracted positions and frame legs 290 are in their extended positions. In the exercise of FIG. 31*a*, user's back 202 is on top of bench 116W while seatback 104U is in the flat position. In the exercise of FIG. 31*b*, seatback 104U is in the inclined position with user 200 seated on bench 116W so that user's back 202 lies against seatback 104U. User's hands 210 move free weights 292 of the dumbbell type in both exercises to exercise user's arms 212.

Variations

While the invention has been described with reference to particular embodiments, this description is solely for the purpose of illustration and is not to be construed as limiting the scope of the invention as claimed below. For instance, the openings in the tines at the remote end of axial bar 186, the openings at the ends of support rod 128, and openings 172 in frame channel portion 166 that adjustably and flexibly receives the frame-associated end of rod 128 in seatback-to-frame/seat connection mechanism 106 or 106U need not be circular. In that case, pins 192 and 194 need not be circular cylinders.

Channel portion 166 of frame 100 can be replaced with a further rail having a plurality of openings respectively corresponding to the pairs of oppositely situated openings 172 in portion 166. The openings in the further rail define corresponding interface connection locations at which the frame-associated end of support rod 128 can be adjustably and flexibly connected to the rail via a frame-associated pin, such as pin 194, that passes through the opening in the frame-associated end of rod 128 and through any selected one of the openings in the rail. Similar to how the remote end of axial bar 186 is configured, the frame-associated end of support rod 128 can also split into a pair of tines through which a pair of oppositely situated openings respectively extend. In that case, support rod 128 is adjustably and flexibly connected to the further rail via a pin that passes through both openings in the frame-associated end of rod 128 and through one of the openings in the rail.

The roles of the ends of support rod 128 in regard to how they are connected to axial bar 186 and frame 100 can be reversed. That is, the seatback-associated end of rod 128 can be adjustably and flexibly connected to axial bar 186 by configuring bar 186 so that its remote end can flexibly receive the seatback-associated end of rod 128 at any one of a plurality of seatback-associated flexible connection locations. This can be achieved by providing the remote end of axial bar 186 with a plurality of openings respectively corresponding to the connection locations. Alternatively, the remote end of axial bar 186 can be configured as a channel member, similar to channel portion 166, having a plurality of pairs of oppositely situated openings where each pair of the oppositely situated openings defines a different one of the connection locations.

When the connection roles of the ends of support rod 128 are reversed, rod 128 is flexibly connected to axial bar 186 at any selected one of the seatback-associated connection locations via a pin that passes through the opening in the seatback-associated end of rod 128 and through one of the openings in the remote end of bar 186 or, if its remote end is configured as the just-mentioned channel member, through one of the pairs of oppositely situated openings in the channel member. If the remote end of axial bar 186 simply has a plurality of openings corresponding to the connection locations, the seatback-associated end of support rod 128 can alternatively split into a pair of tines through which a pair of oppositely situated openings respectively extend. Support rod 128 is then adjustably and flexibly connected to axial bar 186 via a pin that passes through both openings in the seatback-associated end of rod 128 and through one of the openings in bar 186.

A ball-joint arrangement can be used in place of seatback-associated pin 192 for flexibly connecting support rod 128 to axial bar 186 when rod 128 is to be flexibly connected to bar 186 at only one location. Likewise, a ball-joint arrangement can be used in place of frame-associated pin 194 for flexibly connecting support rod 128 to frame 100 when rod 128 is to be flexibly connected to frame 100 at only one location.

The seatback-associated end of support rod 128 can be adjustably and flexibly connected to axial bar 186 at any one of a plurality of seatback-associated flexible connection locations while the frame-associated end of rod 128 is adjustably and flexibly connected to frame 100 at any one of a plurality of frame-associated flexible connection locations. These adjustable and flexible connections for both ends of support rod 128 can be done in any of the ways described above.

Instead of adjustably connecting pedaling mechanism 112 or 220 or handle-translating mechanism 270 to main assembly 116, 116V, or 116W via openings 174 in short rails 164 or via openings 262 in short rails 260, one side of each short rail 164 or 260 can be provided with teeth. The tooth-containing sides of short rails 164 or 260 can, for example, be the sides facing away from the longitudinal center of frame 100. Distance-adjustment knobs 152, 238, or 288 then have internal extensions provided with respective cog wheels whose cogs engage the teeth of short rails 164 or 260. Knobs 152, 238, or 288 are turned to turn the cog wheels for adjusting the connection of pedaling mechanism 112 or 220 or handle-translating mechanism 270 to frame 100 of main assembly 116, 116V, or 116W. The connection is adjusted while knobs 152, 238, or 288 are pulled upward slightly. For any selected adjustment, the connection is locked by pressing knobs 152, 238, or 288 downward sufficiently to engage a locking mechanism.

In the examples of handles 108, 110, 240, 242, and 250 shown in the drawings, each of handles 108, 110, 240, 242, and 250 is open-ended and generally shaped like an "L". One leg of each of handles 108, 110, 240, 242, and 250 extends approximately along its handle axis (See FIGS. 5, 17, and 23) and thus rotates about that axis. Instead of being turned about handle axes, seat handles 108 and 240 can pivot about respective ball joints (not shown) connected to seat 102 or/and frame 100. Similarly, frame handles 242 can pivot about respective ball joints connected to frame 100 rather than being turned about handle axes. Seatback handles 110 and 250 can pivot about respective ball joints connected to seatback 104 or 104U or/and connection mechanism 106 or 106U instead of being turned about handle axes.

Handles 108, 110, 240, 242, and 250 can have other shapes and can be positioned differently than described above. For instance, some or all of handles 108, 110, 240, 242, and 250 can be closed-ended. Seatback handles 110 can be received along the top edge of seatback 104 or 104U or/and along the top of connection mechanism 106 or 106U.

For the situation in which seatback handles 110, seat handles 240, or frame handles 242 turn around axes, the average distance from handles 110, 240, or 242 to another exercise machine part has been described above as being measured from those axes. More generally, the average distance from handles 110, 240, or 242 to another exercise machine part is measured from the average location of the common center of mass of handles 110, 240, or 242 to that other exercise machine part. These two ways of measuring distance from handles 110, 240, or 242 produce largely the same distance value when handles 110, 240, or 242 turn about axes.

Similar generalizations apply to the above statement that the average distance from foot pedals 140 to another exercise machine part is measured from pedaling axis 150, to the above statement that the average distance from foot pedals 224 to another machine part is measured from translator reference line 236, and to the above statement that average distance from translatable handles 274 is measured from translator reference line 286. That is, the average distance from pedals 140 or 224 to another exercise machine part is more generally measured from the average location of the common center of mass of pedals 140 or 224 to that other exercise machine part. The average distance from handles 274 to another exercise machine part is likewise more generally measured from the average location of the common center of mass of handles 274 to that other exercise machine part.

The dimensions of frame 100 may be adjusted to better accommodate users of varying heights or to accommodate users considerably shorter or taller than typical adult users. For instance, short rails 164 can be in the vicinity of 60 cm long so that they extend forward approximately 50 cm beyond the front ends of long rails 160. The length of short rails 260 can be increased similarly.

Structures other than frame legs 290 of "U" shape can be used to enable the top of seat 102 to be in the vicinity of 30-50 cm above the underlying surface when main assembly 116W serves as an exercise bench. For instance, the cross member of each frame leg 290 can be deleted so that the two side members become a pair of separate legs. Alternatively, each frame leg 290 can be furnished with one or more additional cross members that connect the leg's side members. Frame feet 168 can be provided with legs that collapse when suitable leg-locking members are released. Frame feet 168 and frame legs 290 can be viewed as separate elements from frame 100.

Frame legs 290 can be replaced with adjustable retractable legs that enable the top of seat 102 to be placed at any of two or more distances above the surface underlying main assembly 116W. Since the top of seat 102 is at a further distance above the underlying surface when the adjustable retractable legs are fully retracted, the combination of frame feet 168 and the adjustable retractable legs enables the top of seat 102 to be placed at any of three or more distances above the underlying surface. Frame legs 290 can also be replaced with legs that are readily removable from frame 100.

A user can exercise in the crouched, crouched-to-prone, and largely prone positions using pedal-revolving mechanism 112 similar to how user 200 respectively exercises in those positions using pedal-translating pedaling mechanism 220. Various modifications and applications may thus be made by those skilled in the art without departing from the true scope of the invention as defined in the appended claims.

I claim:

1. An exercise bench comprising:

a frame;

a seat situated over the frame;

a seatback at an angle to the seat;

a connection mechanism for adjustably and/or flexibly connecting the seatback to the frame or/and the seat to at least enable the angle between the seatback and the seat to be materially adjusted; and at least three pairs of handles, each pair of handles connected to the frame, the seat, the seatback, or/and the connection mechanism at generally symmetrical locations on opposite sides of the frame, the seat, the seatback, or/and the connection mechanism;

wherein the seatback has a longitudinal centerline, the connection mechanism has a swivel axis about which the connection mechanism is turnable to enable the seatback to swivel, and the swivel axis extends generally parallel to the longitudinal centerline of the seatback.

2. A bench as in claim 1 wherein the handles in at least one of the pairs are turnable.

3. A bench as in claim 1 wherein the seatback is adjustable to a position in which the seatback is largely in line with the seat.

4. A bench as in claim 1 wherein the seat has a top surface, the seatback has a front surface, and the seatback is adjustable to a position in which the top surface of the seat and the front surface of the seatback are largely coplanar.

5. A bench as in claim 1 wherein the seatback is capable of swiveling sufficiently about the swivel axis to enable a typical user to materially exercise the user's abdominal muscles when the user is sitting on the seat with the user's back facing the seatback.

6. A bench as in claim 1 wherein one of the pairs of handles is connected to the seatback at generally symmetrical locations on opposite sides of the seatback.

7. A bench as in claim 1 wherein the seatback has (i) a first transverse edge closest to the seat and (ii) a second transverse edge opposite the first edge and thereby farthest from the seat, one of the pairs of handles being connected to the seatback at generally symmetrical locations on opposite sides of the seatback in close proximity to its second edge.

8. A bench as in claim 1 further including at least one additional pair of handles connected to the frame, the seat, the seatback, or/and the connection mechanism at generally symmetrical locations on opposite sides of the frame, the seat, the seatback, or/and the connection mechanism.

* * * * *